US006720060B1

(12) United States Patent
Swars

(10) Patent No.: US 6,720,060 B1
(45) Date of Patent: Apr. 13, 2004

(54) HONEYCOMB

(76) Inventor: Helmut Swars, Riedweg 11, 51429 Bergisch Gladbach (DE)

( * ) Notice: Subject to any disclaimer, the term of this patent is extended or adjusted under 35 U.S.C. 154(b) by 0 days.

(21) Appl. No.: 09/570,130

(22) Filed: May 12, 2000

(30) Foreign Application Priority Data

May 14, 1999 (DE) ..... 199 22 358

(51) Int. Cl.[7] ..... B32B 3/12

(52) U.S. Cl. ..... 428/116; 428/593; 428/188; 422/177

(58) Field of Search ..... 422/177; 428/116, 428/118, 593, 174, 178, 179, 180, 181, 182, 183, 184, 185, 188

(56) References Cited

U.S. PATENT DOCUMENTS

| | | | |
|---|---|---|---|
| 3,737,978 A | | 6/1973 | Rathbun |
| 4,803,189 A | | 2/1989 | Swars |
| 5,055,275 A | * | 10/1991 | Kanniainen et al. |
| 5,102,743 A | * | 4/1992 | Maus et al. |
| 5,187,142 A | | 2/1993 | Richmond et al. |
| 5,366,700 A | | 11/1994 | Humpolik |
| 5,411,711 A | * | 5/1995 | Swars |
| 5,447,697 A | | 9/1995 | Ito et al. |
| 6,119,328 A | * | 9/2000 | Swars et al. |

FOREIGN PATENT DOCUMENTS

| | | |
|---|---|---|
| DE | 37 26 072 | 2/1989 |
| DE | 42 43 079 | 9/1994 |
| DE | 195 39 168 | 4/1997 |
| DE | 197 31 487 | 1/1999 |
| EP | 0 298 943 | 1/1989 |
| EP | 0 672 822 | 9/1995 |
| EP | 0 711 602 | 5/1996 |

OTHER PUBLICATIONS

Patent Abstracts of Japan, Publication No. 04122418, Publication Date Apr. 22, 1992, Inventor Tanaka Takashi, "Catalyst Converter for Purification of Exhaust Gas Automobile".

* cited by examiner

*Primary Examiner*—Deborah Jones
*Assistant Examiner*—Wendy Boss
(74) *Attorney, Agent, or Firm*—Browdy and Neimark, P.L.L.C.

(57) ABSTRACT

The invention relates to a honeycomb (1), particularly a catalytic converter substrate, with a honeycomb structure comprising a large number of ducts (3) running in the longitudinal direction of the honeycomb (1), through which a fluid can flow, consisting of smooth and/or structured foils arranged to form plane or curved foil layers, and a housing (2) surrounding the honeycomb structure. In order to manufacture an inexpensive honeycomb that displays a sufficiently stable honeycomb structure under the anticipated stresses and that, in addition, is particularly resistance to thermal shocks, it is proposed that stiffening elements (7*a, b*) connected to the foils be provided that are capable of bearing tensile stresses, at least in their longitudinal directions, and that at least partially pass through the honeycomb structure and/or are located on the outside and at least partially surround the honeycomb.

19 Claims, 14 Drawing Sheets

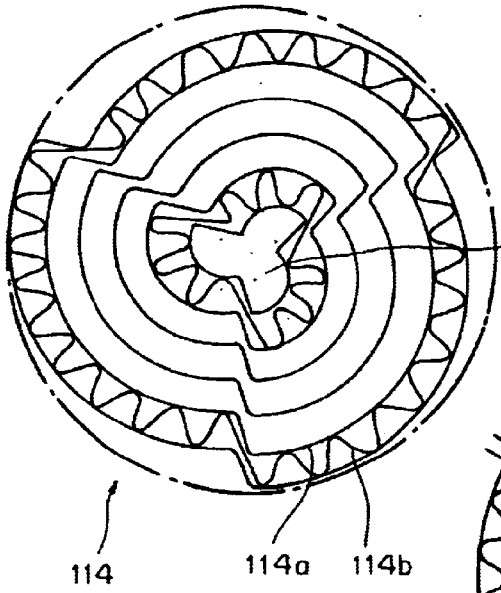
FIG. 14a
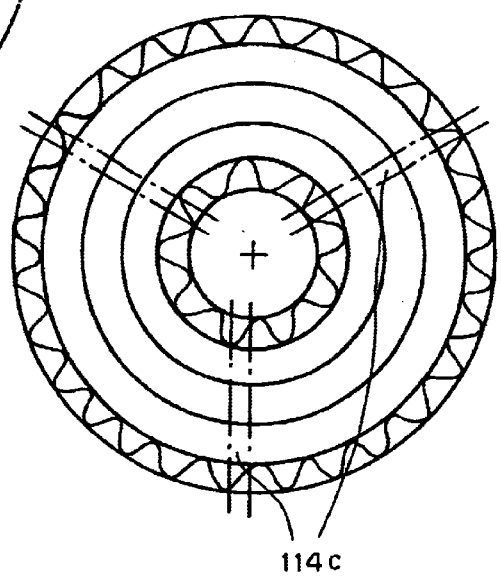
FIG. 14b
FIG. 14c
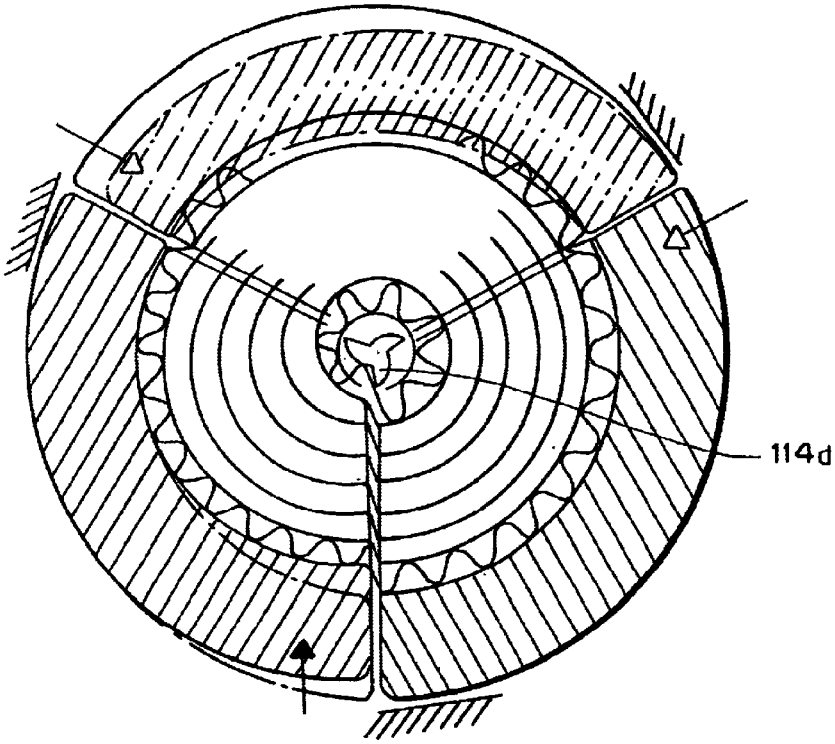

HONEYCOMB

BACKGROUND OF THE INVENTION

1. Technical Field of the Invention

The invention relates to a honeycomb, particularly a catalytic converter substrate, pursuant to the generic part of claim 1 and a process for its manufacture.

The honeycomb can consist of smooth and/or structured foils, which can be arranged in plane or curved foil layers. The honeycomb can be surrounded by a housing, in which several honeycombs can also be accommodated one behind the other or adjacent to each other, where the individual honeycombs can be partially separated by walls or supports.

2. Prior Art

Document EP 0 430 945 B1 discloses a generic honeycomb consisting of at least three stacks of foils, these being folded about an associated bending line and wrapped around the bending line. The end areas of the foils are connected to each other and/or to the housing, at least along part of the lines of contact, by jointing techniques, preferably by brazing, in order to achieve sufficient stability of the honeycomb.

Particularly when using the honeycombs as catalytic converter substrates, they are, as a result of temporal and local temperature gradients, exposed to very high stresses that, particularly as a result of the low strength of the foils and joints, lead to cracks and compression of the honeycombs at high temperatures, and thus to a changing honeycomb structure, this altering the properties of the catalytic converter. It must be borne in mind in this context that the honeycomb can easily be used at temperatures of 900° C. and that temperatures differences within the honeycomb of 300 to 400° C. can occur in this case. Moreover, the joining of the foils by brazing is a comparatively complex and expensive process.

OBJECT AND SUMMARY OF THE INVENTION

The object of the invention is to create a honeycomb that is inexpensive to manufacture, displays a honeycomb structure that is sufficiently stable under the anticipated stresses, and demonstrates particularly high resistance to thermal shocks.

Due to the stiffening elements introduced according to the invention, which extend transverse to the foil layers i.e. intersect the major plane of the foil layers at an angle, for instance a 90° angle, the honeycomb structure is sufficiently stabilised. Forces resulting from temperature changes, for example, are absorbed by the stiffening elements and no longer, or no longer exclusively, by the joints connecting the foils to each other or to the housing. The stiffening elements, which are capable of withstanding tensile forces at least in the longitudinal direction, extend across several ducts through which flow is possible. The stiffening elements can pass through the foils in this context, e.g. two or more than two, and/or at least partially surround the honeycomb on the outside and, if appropriate, extend through or around the entire honeycomb.

The stiffness of the stiffening elements can correspond to that of the foils or, given appropriate orientation, also be less than that of the foils, e.g. half the foil thickness, e.g. using appropriate wires or strips. Preferably, the stiffness in the transverse direction of the stiffening elements is significantly higher than that of the foils, but substantially lower than that of the housing. In this way, while using the same material, the thickness of the stiffening elements can be two to five times the foil thickness of the thinnest foils, possibly up to ten times the foil thickness or more. Referred to the housing, the stiffening elements can display roughly half the housing thickness, advantageously one-quarter to one-eighth of the housing thickness, or also less than this given a corresponding difference between the thicknesses of the housing and the foils. It goes without saying that, given a corresponding choice of material, the stiffness ratios do not directly correspond to the material thickness ratios. The wall thickness of the housing can thus be 0.5 to 1.5 mm, for example, and that of the foil approx. 0.02 to 0.06 mm. This thickness of the stiffening elements can be equal to the foil thickness or a multiple thereof.

If, transverse to their direction of extension, the stiffening elements are elastically deformable relative to the housing and/or mounted on the housing in elastically deformable fashion, e.g. by areas of increased flexibility or extensibility located between them, the honeycomb displays high resistance to thermal shocks and great stability, as the foils are not rigidly fastened to each other by means of the stiffening elements, there being compensation for expansion and simultaneous stabilisation instead. The elastic deformability can exist in one or both directions transverse to the direction of extension of the stiffening elements. The elastically deformable sections are advantagegeously deformable under forces acting at temperature changes between room temperature and about 600 to 1000° C. on the honeycomb, advantageously in an extend that the tensions occurring due to the temperature changes could be absorbed significantly by the elastically deformable sections, for instance to an extend of more than 25% or more than 50%, advantageously substantially complete.

Elements of very high stiffness can also be introduced into the honeycomb, e.g. in the form of one or two-dimensional braces, the stiffness of which can be up to the stiffness of the housing or more and which are fixed to the housing indirectly or directly via elastically deformable areas. Areas of high stiffness thus alternate with the expansion areas guaranteeing the resistance to temperature shocks.

The stiffening elements according to the invention stabilise the honeycomb independently of the housing and permit relative movement of the foils in relation to the housing, this allowing optimum adaptation of the stiffness and load dissipation into the housing, on the one hand, and of the expansion properties, on the other hand, each of which have an influence on the function, stability and resistance to thermal shocks of the honeycomb. Moreover, this can also offer the option, if appropriate, of handling the honeycomb independently of the housing, e.g. when coating with catalytically active material.

The honeycombs according to the invention can, in particular, be used as catalytic converter substrates in the automotive sector, but also for other catalytic converters, e.g. in the power station sector or in chemical engineering. Accordingly, the diameter of the flow ducts can also vary over wide ranges, e.g. from approx. 1 mm to approx. 1 to 2 cm, without limitation. The flow ducts can be of one or two-dimensional design in each case.

The stiffening elements can be of one or two-dimensional design, e.g. in the form of wires, screws, strips, foils, particularly perforated foils or expanded-metal layers or the like. In this context, the stiffening elements can be of straight or curved design and extend parallel and/or perpendicular and/or at an angle to the foils forming the honeycomb structure. If appropriate, foil-type stiffening elements can also be used to divide the honeycomb structure into component honeycombs that are independent of each other in terms of flow, in which case the honeycomb continues to be a single structural unit.

The stiffening elements can be provided with meshing surfaces, such as threads, tooth profiles and the like, to form a positive connection with the respective corresponding component. In addition, the stiffening elements can also display resilient areas or plastically deformable areas extending in their longitudinal direction, these being produced by shaping or bending in each case, e.g. in the form of spiral wire springs, wire, strips of foil sections bent in meandering fashion, slitted foils or strips, expanded metal and the like.

The stiffening elements can be designed as wall sections that partially or completely pass through the honeycomb or border it on the outside as an outer wall. The wall sections can be made of downward-folded sections of the foils that are connected to each other, preferably over a large area. In this context, the sections can be connected by jointing techniques, e.g. spot welding, or in positive fashion, e.g. via braces, such as wires or the like, acting as additional stiffening elements. In particular, the sections can be folded downward in such a way that pockets arise, in which areas of other foils can be positioned, where the pockets are pressed, forming a non-positive and/or positive connection between the foils, or fastened to each other in positive fashion by means of wires. The wall sections can extend in two-dimensional manner over relatively large areas corresponding to a multiple of the diameter in each longitudinal direction, or they can also produce strip-like individual braces, for example.

In particular, the downward-folded sections can extend over the entire length of the foils.

The additional stiffening elements located within the wall sections can be designed as wires or strips. Within a wall section, the one-dimensional stiffening elements can extend parallel and/or perpendicular and/or at an angle to the individual foils. The stiffening elements that run in the plane of the wall can, if appropriate, also pass through the downward-folded sections.

The outer wall areas, in particular, can also be formed of foils laid in meandering fashion, which may also be compressed flat, where the outer walls can be arranged parallel and/or perpendicular to the foils forming the honeycomb structure. The meander-shaped areas can be passed through or surrounded by stiffening elements.

The stiffening elements can be fastened in positive, non-positive or material form to the foils or other stiffening elements, to which end the stiffening elements can pass through the respective components at a distance from their bordering edges, meaning that the stiffening elements are guided through lead-throughs that are closed on all sides. Each of the foil layers can be stabilised by corresponding stiffening elements in this way. In this context, the stiffening elements are advantageously connected to each of the foil layers which they pass through or contact, this being particularly applicable also to the one-dimensional stiffening elements. In this way, the stiffening braces can no longer simply be pulled out. In particular, the one-dimensional stiffening elements that pass through the foil layers, or other wall areas, can be hooked onto the latter in a manner capable of absorbing tensile forces, to which end the stiffening elements can be twisted in such a way that they take on a screw-like shape, forming a positive connection in the process. Alternatively, the stiffening braces can in themselves be designed to be screw-shaped. By means of a non-positive connection, foil areas folded in a V-shape can be fastened to each other, for example, to which end V-shaped folds are inserted into each other and pressed together by applying pressure. Correspondingly, one-dimensional stiffening elements can be inserted in folds of foil sections, which can also be provided on the foil ends, and pressed into these by applying pressure. Material connections can also be designed as soldered connections, e.g. brazed connections, or, in particular, also without filler material, e.g. by spot or diffusion welding.

The stiffening elements can pass through the honeycomb in an irregular, e.g. random, distribution. However, several stiffening elements are preferably provided, which are aligned parallel to each other or whose orientation in one or more directions in space changes regularly, e.g. whose coordinates differ by a constant amount in each case relative to a given reference system. The stiffening elements can thus, for example, be uniformly distributed along an arc, helical or spiral-shaped line. In this way, several stiffening elements are located on a common surface, which can be of plane or curved design, as a result of which so-called structural cells are formed by the virtual surfaces.

Moreover, several groups of stiffening elements are advantageously provided, where, as described above, the stiffening elements within a group are aligned parallel to each other or display an orientation in relation to a system of reference coordinates that differs by a predetermined amount in each case. The stiffening elements of different groups have different orientations relative to each other in this context. In this way, systems of structural cells can be created that pass through each other. As a result, given appropriate orientation of the stiffening elements, the honeycomb structure can absorb very high tensile forces in different directions and thus be optimally stabilised in accordance with the anticipated principal stress directions. Moreover, the cells of the independent cell systems can display different cell sizes and/or have different stiffening elements which, for example, differ in terms of their length, tensile strength, torsional resistance and the like.

The structural cells can extend in one or more directions in space over the entire length of the honeycomb structure and thus, for example, form honeycomb layers, or they can extend over only part of the honeycomb structure. If there are several structural cells interleaved in different manners, these can be considered as primary, secondary, tertiary cells, etc.

The stiffening elements of the structural cells can be arranged in such a way that their respective longitudinal axes run along directions in space which enclose an angle of 45° to 120°, preferably 60° to 90°, relative to each other, but without limitation to these angles. The longitudinal directions of the stiffening elements preferably construct a three-dimensional system. To this end, for example, the stiffening elements of a group can extend in one direction in space of a system of Cartesian, oblique or radial coordinates, for example, where two or three stiffening elements can intersect at one point or the stiffening elements are all separated from each other. Stiffening elements that only surround the honeycomb on the outside are to be included in this consideration.

In all, the formation of corresponding cell systems makes it possible to adjust the stability and, in particular, the natural oscillation behaviour of the honeycomb and its vibrational stability in accordance with the anticipated requirements.

The stiffening elements, including partition and outer walls build by folded foil sections, are preferably fixed to the housing in a manner capable of absorbing forces. For this purpose, the end areas of the foils can be angled downwards in such a way as to form outward-projecting areas. These areas can surround the honeycomb in arc-shaped or helical form over the entire length or part thereof. The outward-projecting areas can be fixed in corresponding recesses, e.g. beads, of the housing, to which end the housing can be plastically deformed, e.g. by applying torsional stress.

One essential aspect of the invention is the division of the honeycomb into component honeycombs which are vibrationally stable in themselves and, if appropriate, also independent in terms of flow, by introducing partition walls. The partition walls as well as the outer walls, for which the statements made in this application corresponding tot he partition walls holds similarly, serve simultaneously to dissipate loads into the housing wall and as expansion compensation areas. Two sides of each foil layer within the component honeycombs can be continuously connected to stiffening elements over the length of the honeycomb via singly or multiply folded sections. The folds permit transverse expansion of the partition wall areas to compensate for expansion between adjacent component honeycombs. The number and/or length of the respective bending legs permits the defined absorption of flexural and tensile stresses. Preferably, both the expansion compensation areas and the partition walls and/or outer walls are formed by folds in the foil, meaning that the wall sections are an integral part of the foils. As transitions between components with widely different material thicknesses are avoided and relative movement of the component honeycombs and the partition walls relative to the housing is possible, difference in expansion in the honeycomb structure can be uniformly absorbed in the structure.

The limitation of the individual deformation paths at the partition walls is achieved by the number of partition walls and their orientation relative to each other and to the housing wall. In this context, both the deformability of the partition walls themselves and the movement of several partition walls relative to each other can be adjusted via angled areas.

Constructing the partition and/or outer walls by connecting appropriately shaped foil areas is not only particularly cost-effective. Even with relatively small, undivided honeycombs, their indirect fastening via partition walls running parallel to the housing wall has advantages in terms of exposure to stress. It eliminates the need for complex connections of the foils to each other and to the housing. Instead, during the winding, folding or stacking process of a prefabrication stage, the honeycomb foils themselves can already be joined together separately, without a housing, to form dimensionally stable parts suitable for handling. This avoids both honeycombs that are mechanically too unstable and also those that are too rigid, e.g. produced by large-area soldering, as a result of which the limits for thermal and mechanical stresses are considerably wider.

In order to construct the partition and/or outer walls, the foils can be folded one to ten times or more, in which context it is also possible, e.g. on alternate layers, to create partition walls which are made up of foil folds that are horizontal and/or vertical relative to the foil layers. In the case of vertical folds, the multiply folded areas are essentially perpendicular to the foil layers, whereas they are essentially parallel to them in the case of horizontal folds.

In a foil system consisting of alternately smooth and structured foil layers, it is also possible for either only the structured foil layers, or only the smooth ones, to be folded in order to form partition and/or outer walls. A wide variety of different types of foil folds can readily be combined in a single honeycomb in order to achieve desired properties. The number of foil layers respectively connected to each other to form a partition wall, or the number of foil folds where individual foil layers are brought into contact with each other by compressing the foil fold, is decisive for the overall thickness of the partition wall and thus for its load-bearing capacity and stiffness. The possibility of compensating for expansion transverse to the partition walls can be varied via the fold height and the length of the bend or fold legs of the individual foil folds in the partition wall area.

The individual foil folds can already be permanently connected to each other by means of familiar jointing techniques when stacking the foils layers in order to construct the partition and/or outer walls. If the honeycomb is manufactured layer by layer, the foil folds of the topmost layer are always readily accessible and can be fastened to each other, e.g. by laterally pressing them together, or by punctiform connections or full-length connecting seams, e.g. by means of welded, bonded or adhesive connections. In particular, ceramic-coated foils can also be used in this context.

By introducing partition walls with defined expansion areas, honeycombs can be produced in which rigid and deformable areas alternate, each of which can extend over the entire cross-sectional width of the honeycomb. Thus, the honeycombs can, for example, display block-shaped, rigid areas that are produced, for example, by soldering of the individual foil layers and separated from each other by narrow deformation zones. The deformation zones can also completely surround the block-shaped areas.

If the honeycomb displays stiffening elements, such as wall areas consisting of several angled foil layer sections connected to each other via connecting points, the foil layers are advantageously fixed to the housing at a distance from the connecting points.

The angled sections can be used to construct a wall area, such as a side and/or partition wall extending over a part of the whole of the honeycomb cross-section, that is preferably essentially gas-tight or essentially prevents gas transport from the interior of the honeycomb to the housing under the conditions in which the honeycomb is used.

In order to fasten the honeycomb, each of the foil layers can, in some areas or over the entire honeycomb, be separately fixed to the housing, particularly in the area of the lateral boundary surfaces of the honeycomb. It is also possible for only one or a few of the foil layers to be fixed to the housing in a given section of the honeycomb. The foil layers fixed to the housing can also be separated by further foil layers, where the further foil layers arranged between the fastened foil layers can be connected to the fastened layer, and thus to the housing, only via further, non-fastened foil layers or directly to the fastened layer. Each of the foil layers can, at least in some sections, also be connected both to the housing and to adjacent foil layers. The individual foil layers can each also be connected to several foil layers in a manner capable of absorbing tensile forces.

On the respective stiffening elements, which can be designed in the form of wall sections, the connecting points between the foil layers are advantageously a distance away from each other on consecutive foil layers. The connecting points are preferably designed to absorb tensile forces. A continuous connection of an internal foil layer to the housing via the connecting points, which would act as a thermal bridge, is avoided in this way. The connecting points can be a distance away from each other in a direction parallel to the foil layers, to which end the angled, interconnected sections of the foil layers can each be of a different length. Preferably, the connecting points are a distance away from each other along the height of the side wall, i.e. in a direction perpendicular to the foil layers.

A bead or a U-shaped groove can be provided on the housing for fastening the foil layers, although fastening can also be accomplished in some other suitable manner. The foil layers are preferably fastened to the housing by means of tabs folded outwards from the foil layers.

Between the areas of the honeycomb through which gas can flow and the points at which the foil layers are connected to each other, the foil layers preferably display sections with increased extensibility compared to the foil layer structure, where the direction of extension is preferably perpendicular to the wall sections. To this end, the fastening sections of the foil layer can be folded once or several times, e.g. 5 to 10 times, e.g. in V-shaped or zigzag form. In this context, the fold legs can be in close contact with each other or a slight distance apart. The length of the expansion legs can be three to twenty times the layer thickness of the foil layers or one to ten times the distance between foil layers, without limitation to these values. Given a corresponding arrangement of the connecting points between the foil layers, stiffening elements can thus be constructed, e.g. in the form of walls, which can absorb high tensile forces in one direction and display high extensibility perpendicular thereto. By appropriately folding and fastening the foil layer sections or stiffening elements, areas of increased extensibility can also be provided between areas of high tensile strength.

The foil layers are preferably connected to each other in such a way that, starting from the fastening point of the foil layers on the housing, a line extending in the direction of the inside of the honeycomb is obtained that connects the connecting points of the foil layers to each other, thus increasing the extensibility of the wall area opposite the housing.

The walls described above advantageously extend over the entire height and entire length of the honeycomb, where the walls can be of essentially gas-tight design. If feed-throughs are provided in the walls, e.g. as a result of notched fastening tabs, the feed-throughs are preferably covered in essentially gas-tight fashion by covers, so that the area of the honeycomb through which the gas flows is isolated from the housing. Separate covers or sections of adjacent foil layers can serve this purpose, to which end the length of the overlapping sections of the foil layers can be dimensioned appropriately. Moreover, only some of the foil layers can be provided with notched tabs, or the notched tabs of different foil layers are a distance apart in the direction of extension of the foil layers, so that an opening arising in a foil layer as a result of a notched tab is covered in essentially gas-tight fashion by an adjacent foil layer. The interior of the honeycomb can be provided with additional thermal insulation in this way while, at the same time, the fastening areas of the foil layers on the housing are at a lower temperature than the interior of the honeycomb, meaning that they are subjected to less material stress. A particularly good insulating effect is achieved by a multi-layer structure of the walls.

The wall constructed from overlapping foil layer sections is preferably designed in such a way that, at a temperature of approximately 900° C. on the inside of the honeycomb and an much lower outside housing temperature (for instance of 100 to 400° C. or lower), the fastening areas of the foil layers have a temperature of lower than approximately 500 to 600° C. and can thus be exposed to greater mechanical stresses. To this end, the wall thickness, and thus the length of the overlapping foil layer sections forming the wall, must be selected appropriately as a function of the thickness of the foil layers. The temperature gradient obtained is additionally determined by the position of the connecting points of the individual foil layers in relation to each other.

The housing accommodating the honeycomb preferably has a double wall, such that the housing has a sandwich-like structure and displays an inner and outer housing. The inner housing preferably consists of ferritic material and the outer housing of austenitic material. The inner housing can display openings in order to fix areas of the honeycomb, e.g. notched tabs of the foil layers, or stiffening elements, such as stiffening wires, or side and partition wall areas. To this end, the inner housing can display areas capable of relative movement, between which, in the limit approach position, the areas of the honeycomb can be fixed, e.g. foil tabs or stiffening elements. To this end, the inner housing is preferably split in the transverse direction, thus producing two or more areas of the inner housing that completely surround the honeycomb and that can be moved, e.g. slid or rotated, relative to each other in the longitudinal direction in order to fasten the honeycomb. If appropriate, the inner housing can also be split longitudinally or display a parting line with a different profile. The inner housing can also display areas notched out in the form of tabs, which can particularly end at the face ends of the inner housing and which can be displaced relative to another part of the inner housing in pre-assembled condition. The area of the honeycomb fixed in the opening in the inner housing preferably reaches behind the inner housing on the side facing the outer housing, so that the area reaching behind can additionally be fixed between the inner housing and the outer housing, e.g. by a non-positive connection. When fastening the honeycomb in the housing, the honeycomb can first be fixed in the inner housing, after which the inner housing is fixed to the outer housing in a manner preventing displacement. For fastening the honeycomb in the inner housing, the latter is preferably already located in the outer housing, at least partially. The honeycomb can be fastened in that another part of the inner housing is slid into the outer housing and the fastening areas of the honeycomb are fixed, e.g. clamped, between the parts of the inner housing.

In order to manufacture a honeycomb according to the invention, layers of foils, arranged one on top of the other and ready-made in the required size, can be stacked and the corresponding foil stacks provided with stiffening elements.

Layers of foils are advantageously pre-shaped and, before or after shaping of the foil layers, stiffening elements inserted between these, the foil layers being cut off together with the stiffening elements for appropriate finishing. If appropriate, further stiffening elements can be introduced before cutting in order to fix the foil layers. The foil layers can subsequently be given the required shape and, if appropriate stabilised with further stiffening elements in this condition.

For shaping, stacked foils, e.g. alternating smooth and corrugated foil layers, can be put together to form a foil stack and laid in meandering fashion. Foils or expanded-metal layers can be inserted between the individual meandering layers as stiffening elements and, if appropriate, fixed to the foil layers by way of one-dimensional stiffening elements. The meandering foil stack formed in this way can be divided up using cutting equipment, after which the resultant pieces can be shaped into honeycombs.

When shaping the foils in order to form the honeycomb, the foils can be heated, also only in some areas, if appropriate. This is advantageous, particularly if the honeycomb consists of foils laid in zigzag fashion. To this end, it usually suffices to heat the foils only in the area of the bending points, preferably by means of resistance or induction heating. In particular, heating of the foils is also advantageous if they are pressed together with each other, or with stiffening elements, to form a non-positive connection.

The partition walls can be manufactured by the foils previously arranged one on top of the other being permanently deformed in stacks. To this end, previously preheated areas of the honeycomb can be deformed by forces applied externally to the honeycomb and acting in the longitudinal or transverse direction of the stacked layers. In this way, the foils can be folded in a single step over the entire height of the foil stack, regardless of its shape. If appropriate, the folding of the foils can be supported by exerting compressive or tensile forces acting perpendicular to the foil layers. In order to avoid undesired deformation of the foils, the corresponding sections of the honeycomb can be filled with packing material or bulk materials, such as sand.

In order to use the honeycomb as a catalytic converter substrate, the foil surface usually has to be roughened, e.g. by forming an oxide layer. The surface of the flow ducts is subsequently covered with a ceramic coating compound which either already contains the catalytically active substance or is subsequently provided with it. To this end, the definitively shaped honeycomb can be provided with an oxidic adhesion layer by heating in an oven or by resistance heating. However, pre-oxidised foil layers can also be used. Accordingly, the foil layers may already be provided with an adhesive ceramic layer even before deformation.

Advantageously, before being coated or before being installed in the housing, the honeycomb is calibrated by external compression transverse to the foil layers, in which context the duct shape and the clearance for expansion on the transversely deformable cell walls can also be set. To this end, the honeycomb can be heated to a deformation temperature, in which context it is advantageous for only individual areas of the volume of the honeycomb to be heated, e.g. individual layers. When pressure is exerted on the honeycomb in this condition, the non-heated areas are virtually not deformed at all, meaning that targeted shaping in specific areas is possible.

In particular, the honeycomb can be heated by resistance heating. Diffusion welding, high-temperature soldering or oxidation of the foil surface to increase its roughness can be carried out together with calibration.

The stiffening braces can be tensioned or re-tensioned during or after calibration.

In detail, the different variants of the honeycomb can be manufactured as follows.

In order to manufacture a honeycomb with a large number of foil layers, stacked in zigzag fashion and in part structured, a cuboid honeycomb stack can be formed by transverse folding of a longitudinally structured foil strip along perforation lines. In order to form secondary cells, wires, strips or the like are inserted between and/or through the foil layers during the folding process, depending on the specific design variant. The webs between the perforation holes are electrically contacted on both sides in the longitudinal direction and resistance-heated in order to form sharp-edged bending lines. In order to calibrate the foils, they are then electrically contacted and resistance-heated on side tabs transverse to the corrugation, the wires, strips and the like are tensioned, and the foils pressed together with lateral support. Given an appropriately set atmosphere, the process of heating for calibration provides the honeycomb with an adhesive oxide layer for the ceramic coating applied later. The shape of the calibrated honeycomb stack is then fixed by moulding and joining the outer lateral cell walls and partition walls and/or positively-fitting insertion or screw-fastening of braces before being coated with ceramic material. Individual honeycombs are then cut off, and the remaining outer cell walls or insulating walls and the housing fastening ribs moulded onto them. The honeycomb can then be joined to the fastening ribs on the housing wall.

As an alternative intermediate manufacturing step, the structured and perforated foil strip can be provided with a ceramic coating before being folded together into a foil stack. Moreover, the foil stack can be stabilised during electrically heated calibration in a vacuum by specifically applying pressure to the points of foil contact in order to form diffusion welds. Alternatively, solder joints can be formed at the points of contact during calibration by using wires or strips coated with solder material that are arranged between the foil layers, or by locally coated foils.

According to another variant, a honeycomb with housing can be manufactured as follows. A multi-layer strip stack with alternating smooth and corrugated foils is bent in meandering fashion and pre-fixed. Depending on the design variant involved, the folds with aligned meshing are produced beforehand. The introduction of bracing elements as additional cell walls fixes the curved, bent or wound stacks and connects them to inserted foils, e.g. expanded-metal foils. Pre-fixed honeycomb stacks are cut off by full-length transverse parting cuts through all layers. Following compression and moulding of compacted multi-layer folds on the foil ends, the honeycomb is compression moulded, calibrated and then joined with the cell walls. After being catalytically coated in advance, the honeycombs are fastened in the housing by means of integrally moulded external fastening ribs.

Coated or uncoated foils of alternately smooth and corrugated design can also be provided with foil folds during spiral winding and subsequently joined to form multi-layer cell walls in aligned toothed lines of defined orientation. During winding, an expanded-metal foil layer is introduced on the inside of the honeycomb and on the outer circumference and inserted in the toothed lines in the process. The honeycombs can be calibrated as described above, either with or without heating.

For transporting the honeycombs, the housing can simultaneously be used as transport packaging. In order to manufacture a catalytic converter, a tubular housing with a number of honeycombs arranged one behind the other can be divided in accordance with the size of the honeycombs. In this context, the honeycombs can be fixed to the housing wall, also regardless of the use of the housing as transport packaging, by means of ribs, e.g. spiral-shaped ribs, to which end the outward-projecting ribs can be fastened in beads provided in the tubular housing. The housing can have a single or double wall and serve to accommodate several honeycombs next to each other.

The inlet and outlet areas of the honeycomb can display foil layer sections or separate inserts with surfaces that run at an angle to the principal plane of the foil layers and improve the inflow behaviour as a whole as a result of the induced flow deflection. The foil layers are reinforced by the corresponding structuring of the foils in the turbulent inlet area. The inlet and outlet areas are advantageously reinforced by additional stiffening elements according to the invention.

BRIEF DESCRIPTION OF THE DRAWINGS

FIG. 14 shows manufacture of a honeycomb from smooth and corrugated foil layers.

An example of the invention is described below and explained on the basis of the figures.

Figure 1B:
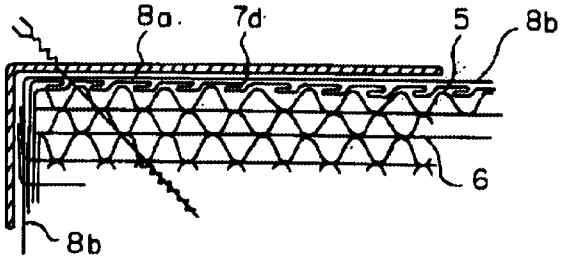
FIGS. 1*b,* 1*c* and 1*d* shows an additional design alternative of a cuboid honeycomb.
Figure 1D:
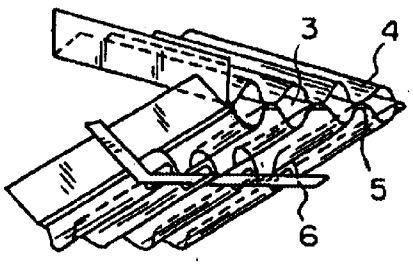
FIG. 1 shows a cross-section of a cuboid honeycomb in a metal housing shell.
Figure 1A:
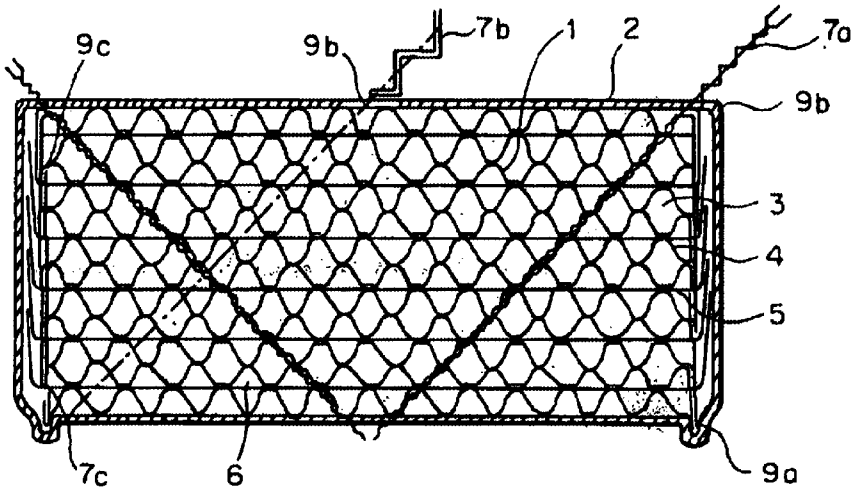
Figure 1C:
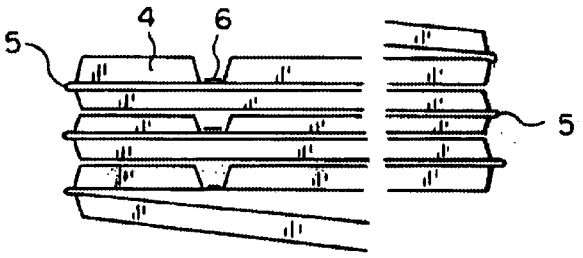

FIG. 1*a* shows a cross-section of a cuboid honeycomb 1, formed from stacked, corrugated foils, in a metal housing shell 2 as a composite structure. The approximately round flow ducts 3, which are formed by opposite foil corrugations 4, are pakked in the densest possible trigonal arrangement. To this end, the foil layers are folded in zigzag fashion in the longitudinal direction, as indicated in FIG. 1*c* and FIG. 1*d.* The foil layers advantageously remain connected by narrow connecting webs 5 on the fold lines. The honeycomb structure which can, however, still be pushed together in the manner of a crane's bill at the sides, is stabilised by braces 6 made of woven-in strips between every other foil layer. In this way, long, rectangular secondary cells are formed, each encompassing two duct rows. Superimposed on these, there are larger, triangular tertiary cells, formed by wire screws 7*a* or 7*b,* screwed in in positive fashion, which provide additional stabilisation. In the case of relatively large flow ducts, the wire screws can be of thin design 7*a* and arranged in alignment with the duct walls. Alternatively, extensible wire spiral springs 7*b* are advantageous for relatively small duct cross-sections. The tertiary cells are bordered by folded foil ends 7*c* on the outside of the lateral honeycomb wall. On the top and bottom side, the housing wall forms part of the tertiary cell walls in some sections.

FIG. 1*b* shows an additional design alternative 7*d.* At the top, the cell wall structure is formed by a corrugated foil that is pressed flat and reinforced by a smooth foil 8*a.* As an alternative, or in addition, to foil 8*a,* stiffening wires 8*b* can also be integrated in this wall structure or in lateral cell walls 7*c.* Together with side walls 7*c,* upper and lower walls 7*b* thus form an outer, rectangular quaternary cell. In order to dissipate the principal loads, the cell walls are connected to the housing at points 9*a* in such a way that their differential expansion relative to the cold housing wall is unobstructed. Braces 7*a* or 7*b* are likewise connected to the housing wall at points 9*b* for load dissipation. In contrast, bracing strips 6, the location of which within the honeycomb is shown in FIG. 1*d,* are only firmly connected to cell walls 7*c* at points 9*c,* or their ends are integrated in the wall structure. Quaternary cell walls 7*d,* which form a multi-layer structure through which flow is not possible, act as thermal insulation between the primary honeycomb and the housing wall.

Figure 2A:
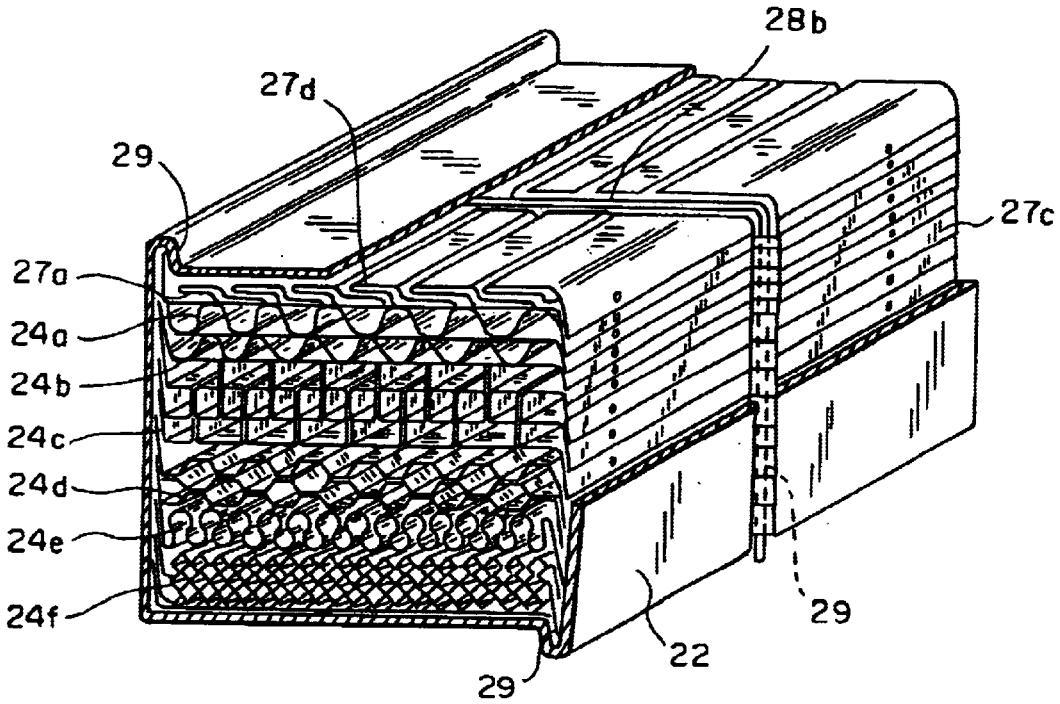
FIG. 2*a* shows a perspective view of a cuboid composite honeycomb illustrating alterative foil structures.

FIG. 2*a* shows a perspective view of a cuboid composite honeycomb, illustrating alternative foil structures that are known in themselves and can be used here. The upper rows of flow ducts are formed by corrugated foils 24*a* and smooth foils 24*b.* The foil structure as per 24*c* forms catalytically more favourable rectangular or square ducts, although partly with double walls. The ducts in the bottom rows, with foil structures as per 24*d,* 24*e* and 24*f,* are more favourable, without double walls and in the densest possible trigonal arrangement, almost approaching an ideal, round duct form. Except for the sinusoidal upper ducts, all the other illustrated duct structures displaying more favourable flow require a stabilising outer border, in order to prevent or limit displacement of the ducts relative to each other. The roughly square, outer secondary cell structure is formed by overlapping folded foil edges 27*c* at the sides and by structured foils with flattened corrugations 27*d* and an additional stabilising wire 28*b* at the top and bottom. It has a multiple function, simultaneously serving to support the honeycomb ducts, to join and fix honeycombs suitable for handling, to fasten the honeycomb to housing 29 and to provide thermal insulation. It may be sufficient to fasten the side walls in diagonally opposite areas on fastening points of housing 29. In this way, the honeycomb can rotate relative to the housing or be deformed in the shape of a rhombus. Right-angled, outward-projecting notched foil tabs can also be provided to form a fastening rib.

Figure 2C:
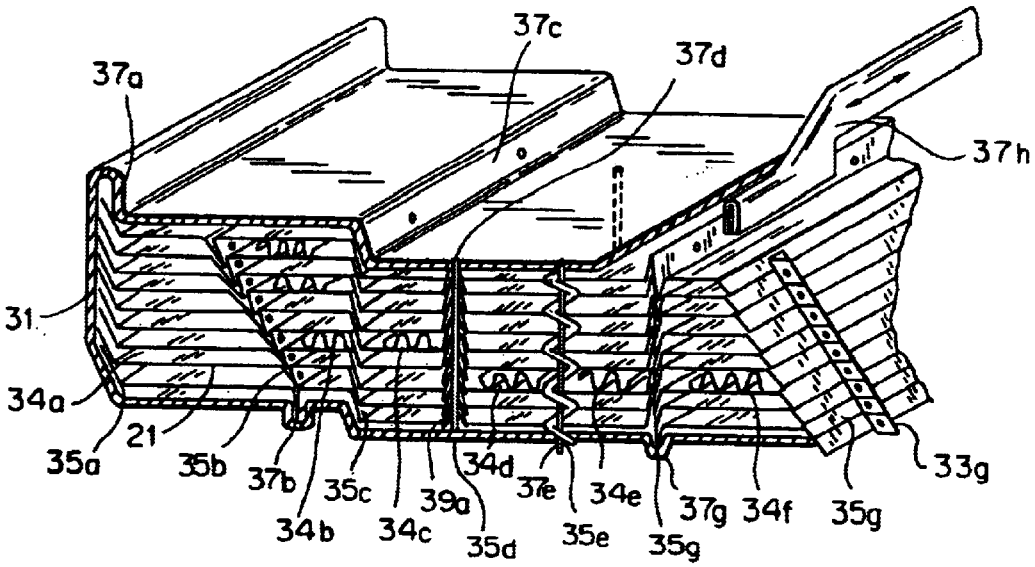
FIG. 2*c* shows various possible arrangements of partition walls and their type of fastening to the housing wall.
Figure 2B:
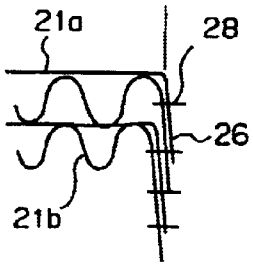
FIG. 2*b* shows an selection of useable foil folds for forming partition and outer walls of a honeycomb.
Figure 2B:
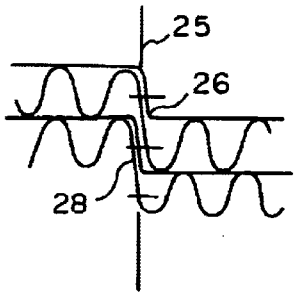
Figure 2B:
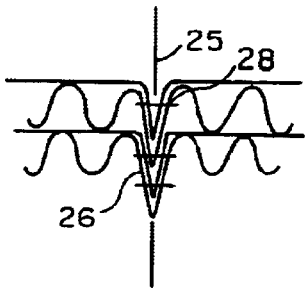
Figure 2B:
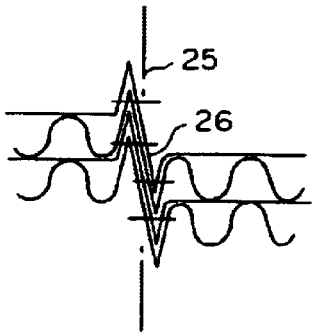
Figure 2B:
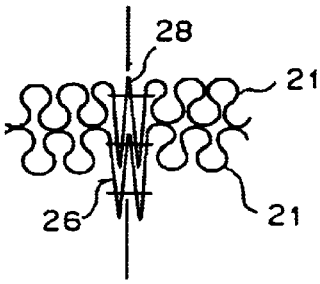
Figure 2B:
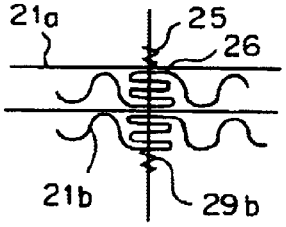
Figure 2B:
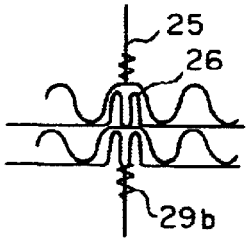
Figure 2B:
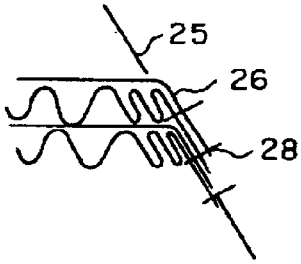
Figure 2B:
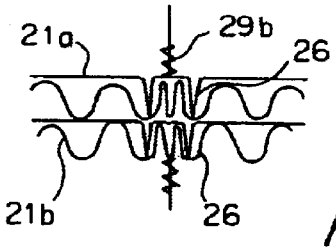
Figure 2B:
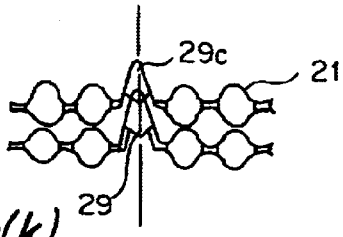
Figure 2B:
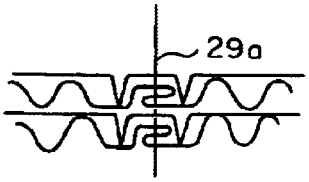

FIG. 2*b* shows, by way of example, an extensive selection of useable foil folds 26 for forming partition and outer walls, each with a different stiffness and transverse extensibility. The transverse extensibility makes it possible to provide for expansion or broadening of the partition wall in the transverse direction without altering the position of the partition wall in the process. The foil folds can be designed as an L-shaped single bend (A), a Z-shaped double bend (B), a V-shaped triple bend (C), a zigzag-shaped fourfold bend (D) or also a W-shaped fivefold bend (E), where the length of fold legs 26 can vary at the same time. The wall thickness can be influenced by the number of fold legs 26 fixed to each other in each case. In terms of the properties of the partition walls, e.g. the transverse extensibility, the nature and arrangement of joints 28, indicated by a line, is also of major importance. They can, for example, be designed as spot welds or also as connecting wires displaying low slip. Both an identical folding direction on similarly structured foil layers 21 (see design E) and different fold directions with differently structured foil layers 21*a,* 21*b* (see practical examples F and L) are possible. In variant F, the partition wall structure is held together only by joining elements 29*b,* e.g. screws, while variants G or J and L are provided not only with screw connections 29, but also with additional mutual positive meshing of the smooth and corrugated foil layers. Joints 28 in variants A to E and H can be produced using known processes, e.g. spot welding or punched positive cramping during layer-by-layer construction of the partition walls. In variants F, G, J and L, additional stiffening elements, such as pins, screws or strips 29, can be introduced into the partition walls even after construction of the partition walls. According to variant K, the V-shaped foil folds are meshed in hinge fashion by notched tabs in the longitudinal direction and smaller V-shaped counterfolds of one of the double layers, where the foils are slide into one another layer by layer and firm transverse connections are formed by connecting wires 29*c* passing through the folds.

FIG. 2*c* shows various possible arrangements of partition walls 35*a* to 35*g* and their type of fastening 37*a* to 37*h* to housing wall 31. The structure of partition walls 35*a* and 35*g* on the honeycomb sides parallel to housing wall 31 corresponds to example A in FIG. 2*b* that of partition walls 35*b,* 35*c* and 35*g* to examples C, B and D in FIG. 2*b*. Partition walls 35*d* and 35*e* are formed from several individual braces arranged in line in the direction of flow. Individual brace 35*d* is formed from necks which each rest on the adjacent foil layer and are fixed to this. To this end, a wire-like additional connecting element 39*a* is provided, which runs through the middle of the necks and presses the foil layers together through the necks. The necks can, for example, also be fastened to the foil layers by means of welds. Moreover, the foil layers can be fixed by screw-like or spiral spring-like braces 35*e*. The spring constant of the spiral spring can be adapted to the strength of the foils and be slightly below or above it.

Restraints 37*a* to 37*g* of the partition wall ends on the housing wall can be arranged opposite each other or offset relative to each other. In this context, several adjacent partition walls in the composite honeycomb can expand or move in the same direction relative to each other (see 35*d,* 35*e,* 35*g*) or in opposite directions relative to each other (see 35*a,* 35*b*).

Linear-type fasteners 37*a* to 37*g* can be oriented in the longitudinal and parallel direction to each other or (see fastener 37*a,* 37*b* on component honeycomb 34*f*) oriented transverse to each other and to the direction of flow and to opposite partition wall 33*g*. In the case of particularly large, relatively flat honeycomb elements, additional external transverse stabilisation of the housing walls in the inlet and outlet area is provided by means of supporting the face end of the honeycomb via fastener 37*h* of partition wall 35*g*.

The exemplary stiffening elements illustrated in FIGS. 2*b* and 2*c* can display areas of high stiffness, e.g. in the region of the stiffness of the housing, and be fixed to the housing in deformable or extensible fashion in such a way that the position of the foil layers acting on the stiffening element is variable relative to the housing. To this end, the areas of the stiffening elements that are adjacent to the housing can display elevated flexibility, e.g. on the basis of the material thickness or material properties, and/or they can be fixed to the housing in movable fashion, e.g. permitting angling motion relative to the housing.

Figure 3:
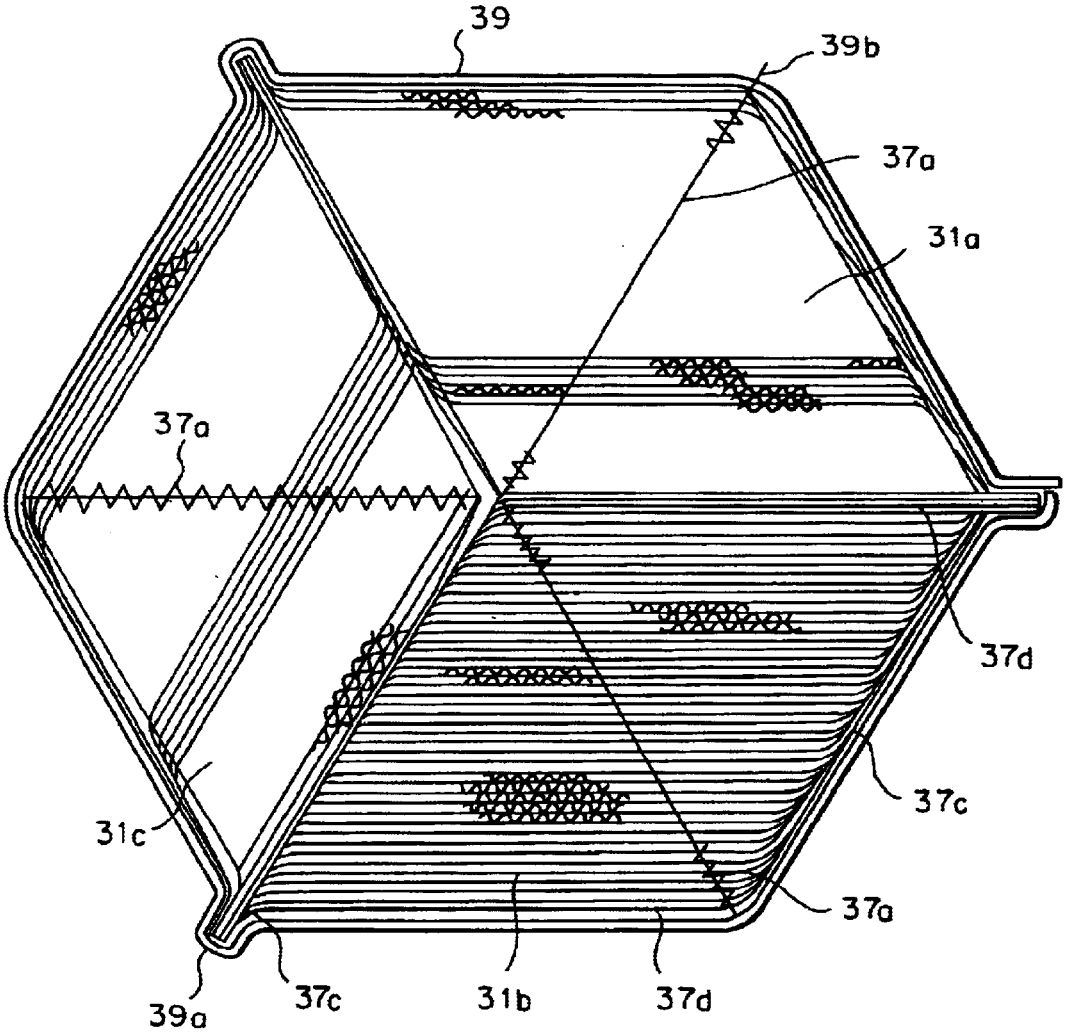
FIG. 3 shows a cross-section through a honeycomb/housing system with three prefabricated, parallelogram-shaped individual honeycombs.

FIG. 3 shows the cross-section through a honeycomb/housing system with three prefabricated, parallelogram-shaped individual honeycombs 31*a,* 31*b,* 31*c*. Each of these is divided into two triangular secondary cells and bordered by a tertiary cell structure 37*c,* 37*d* on the outside. Tertiary cell wall 37*c,* which can move relative to the housing, is formed by singly downward-folded, tab-like end areas of the metal foils that overlap each other in the manner of scales. The end areas are fastened to each other by spot welds and can be additionally stabilised by means of stiffening wires. The stiffening wires can be fixed in fastening grooves 39*a* of the housing, together with the end areas of the foils.

The triangular cell division is formed by several wire screws 37*a* aligned in a row. All other cell walls 37*c,* 37*d* are simultaneously part of the inner triangular structure and the parallelogram-shaped tertiary cell structure. As a result of their common restraint in housing 39, two outer walls of these, designed as per 37*c* and 37*d,* also form the hexagonal quaternary cell encompassing all the components. The honeycombs are connected to the housing via cell walls 37*c* at points 39*a* and additionally via braces 37*a* at points 39*b*.

Figures 4A, 4B:
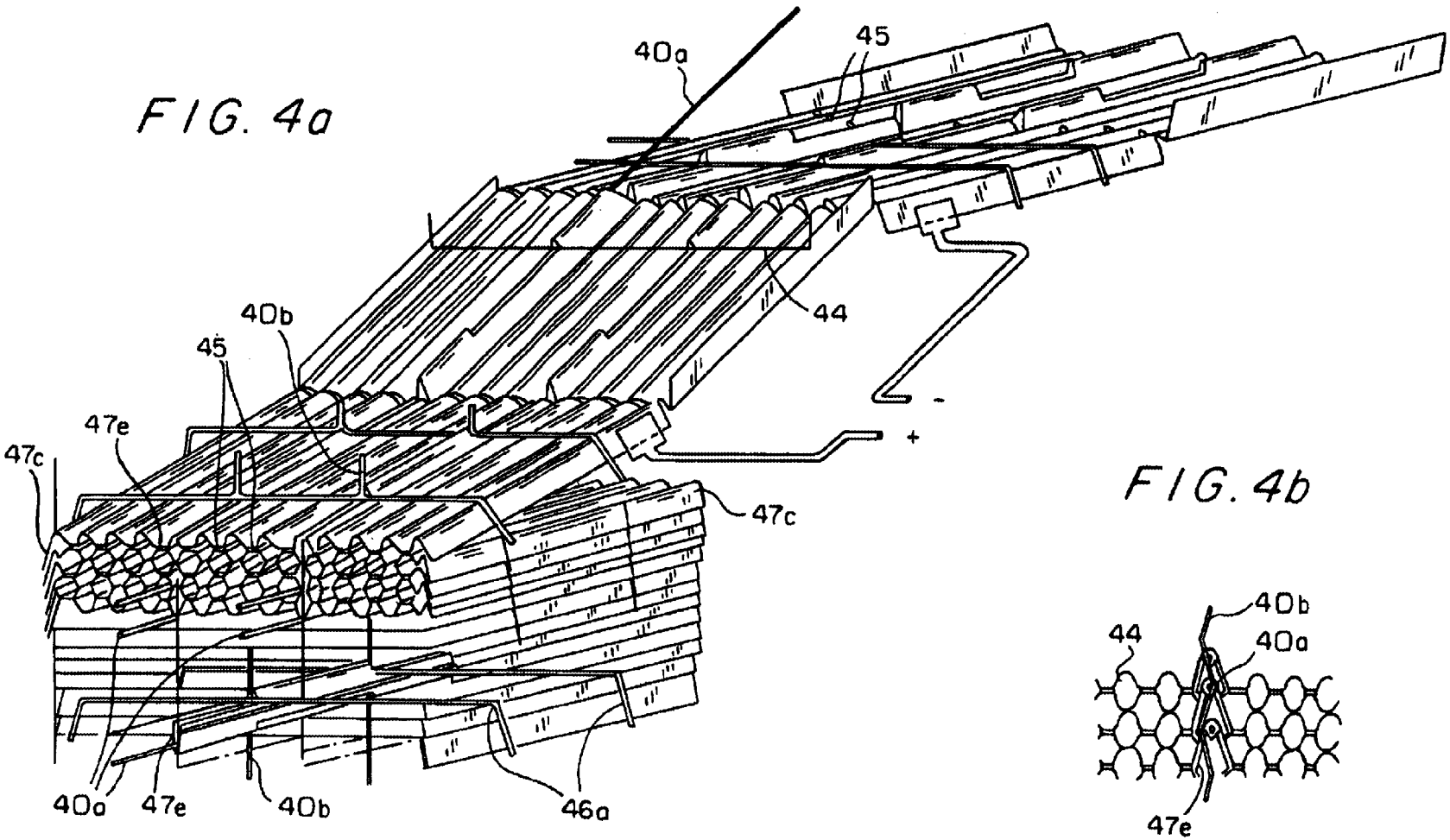
FIG. 4*a* shows a perspective view of the structure and manufacturing method of a cuboid composite honeycomb with a narrow, rectangular secondary cell structure.
FIG. 4*b* shows the structure of FIG. 4*a* wherein folds are connected in hinge-like fashion by axially offset notched tabs.

FIG. 4*a* shows a perspective view of the structure and manufacturing method of a cuboid composite honeycomb with a narrow, rectangular secondary cell structure comprising two wires 46*a* aligned one behind the other. Superimposed on the secondary cells, larger, roughly square tertiary cells are formed from V-shaped folds 47*e,* located inside the honeycomb, and overlapping folded edges 47*c* of foils 44, located on the outside, these each representing further stiffening elements. The housing and further cell walls on the top and bottom side have been omitted to simplify this illustration. The primary honeycomb structure is formed by the zigzag folding of a corrugated foil strip that is perforated along the fold lines. The perforation is formed by punching in such a way that only narrow connecting webs 45 are left, these permitting simpler, accurately fitting folding and just sufficient support and connection of the foil layers with the minimum possible flow pressure loss. Folding without plastic over-elongation of the connecting webs is favoured by targeted heating only in this bending area. To this end, the foils are electrically contacted as folding progresses, so that all the connecting webs on one fold line are simultaneously heated to the shaping temperature by way of resistance heating. Vertical inner partition walls 47*e* are joined by means of horizontal wires 40*a*. After being slid into each other, folds 47*e* are connected in hinge-like fashion by axially offset notched tabs (see FIG. 4*b*). In addition, vertical stabilising wires 40*b* are passed through on the inner partition walls in the manner of a woven pattern. As a result, there is an integrated three-dimensional wire structure with the honeycomb structure made up of foils.

For additional stiffening, thicker foil layers or foil strips can also be inserted between the foil layers and parallel to them, and these can also consist of several foils arranged in sandwich fashion one on top of the other.

Figure 5:
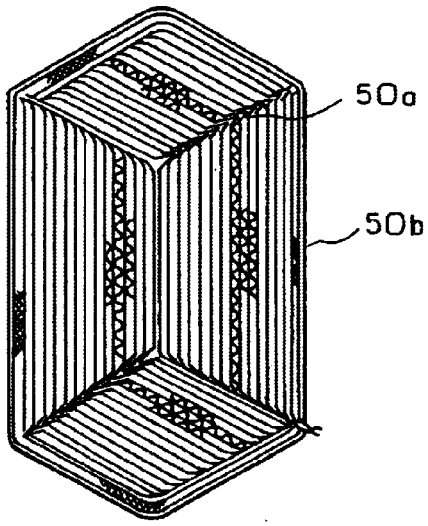
FIG. 5 shows a composite honeycomb made of two bent component honeycombs in a common housing.

FIG. 5 shows a composite honeycomb made up of two bent component honeycombs 50*a* in a common housing 50*b*. Each of these component honeycombs is, in turn, divided into two secondary cells, one of trapezoidal shape and the other of parallelogram shape. The inner and outer partition walls are formed in the same manner as in the configurations described above.

Figure 6:
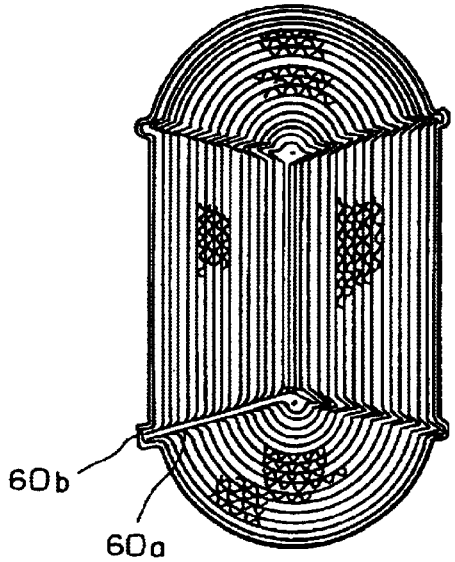
FIG. 6 shows a honeycomb configuration with secondary cells in the shape of trapezoids and sectors of a circle.

FIG. 6 shows, in the same manner as FIG. 5, a configuration with secondary cells in the shape of trapezoids and sectors of a circle.

Figure 7:
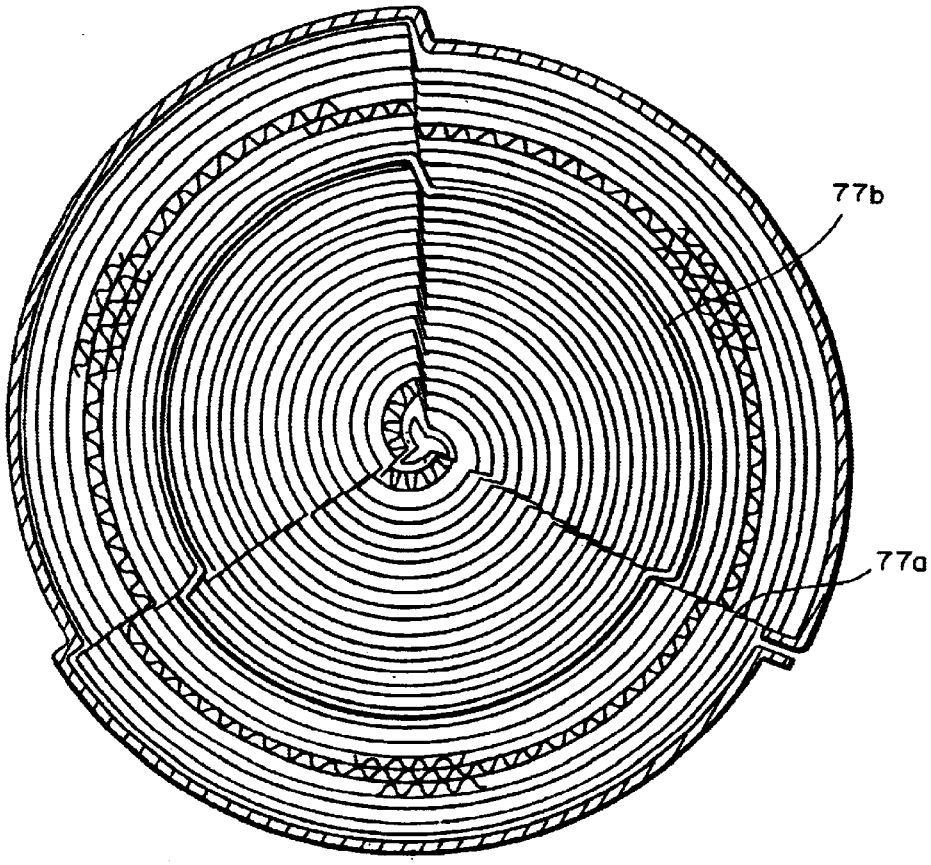
FIG. 7 shows a round honeycomb, wound spirally from smooth and corrugated foils, which is divided into six secondary cells.

FIG. 7 shows a round honeycomb, wound spirally from smooth and corrugated foils, which is divided into six secondary cells. Walls 77*a,* running towards the centre, are built up of foil folds during winding. Circular support 77*b* is made of expanded-metal foil, which is inserted during winding and meshed in walls 77*a.* Cells with the shape of ring segments are thus divided off towards the outside.

The partition walls are formed from e.g. Z-like zigzag-shaped folds as per variant B, D and others in FIG. 2*b,* these being formed during unwinding of the foil strip from the coil and meshed with each other in order to form the partition walls. The partition walls can be fastened to the housing.

Figure 8A:
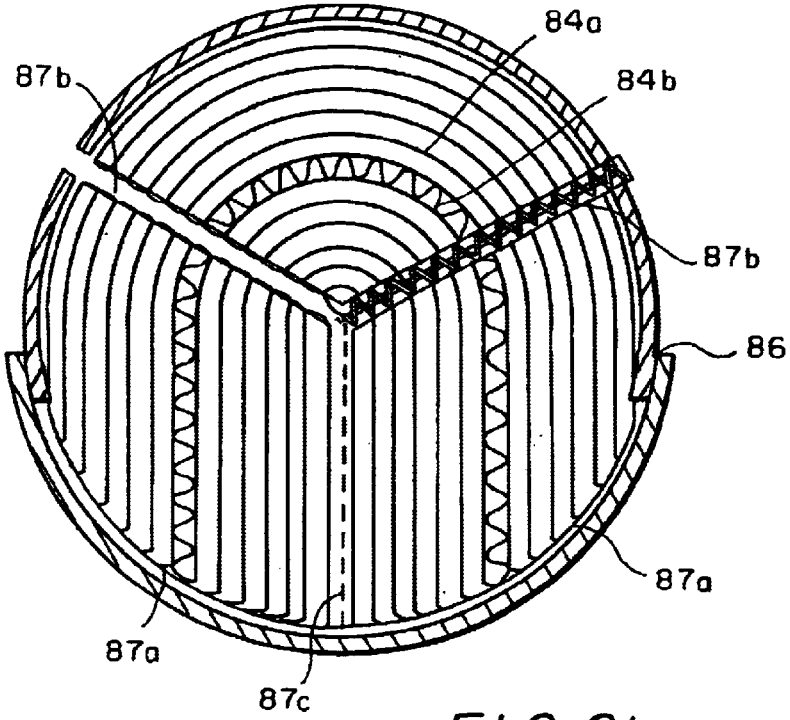
FIG. 8*a* shows a U-shaped composite honeycomb structure with three secondary cells made of smooth foils and corrugated foils.

FIG. 8*a* shows a U-shaped composite honeycomb structure with three secondary cells made up of smooth foils 84*a* and corrugated foils 84*b*. Outer secondary cell walls 87*a* are formed from overlapping folded foil edges. As an alternative thereto, the inner cell walls are formed from several braces 87*b,* arranged in alignment, and from expanded metal 87*c*. Fastening points 86 of the partition walls on the housing wall are simultaneously designed as a housing/foil connecting weld. Correspondingly, partition walls, e.g. made of V-shaped folds, can be welded into connecting seams of housing parts.

Figure 8B:
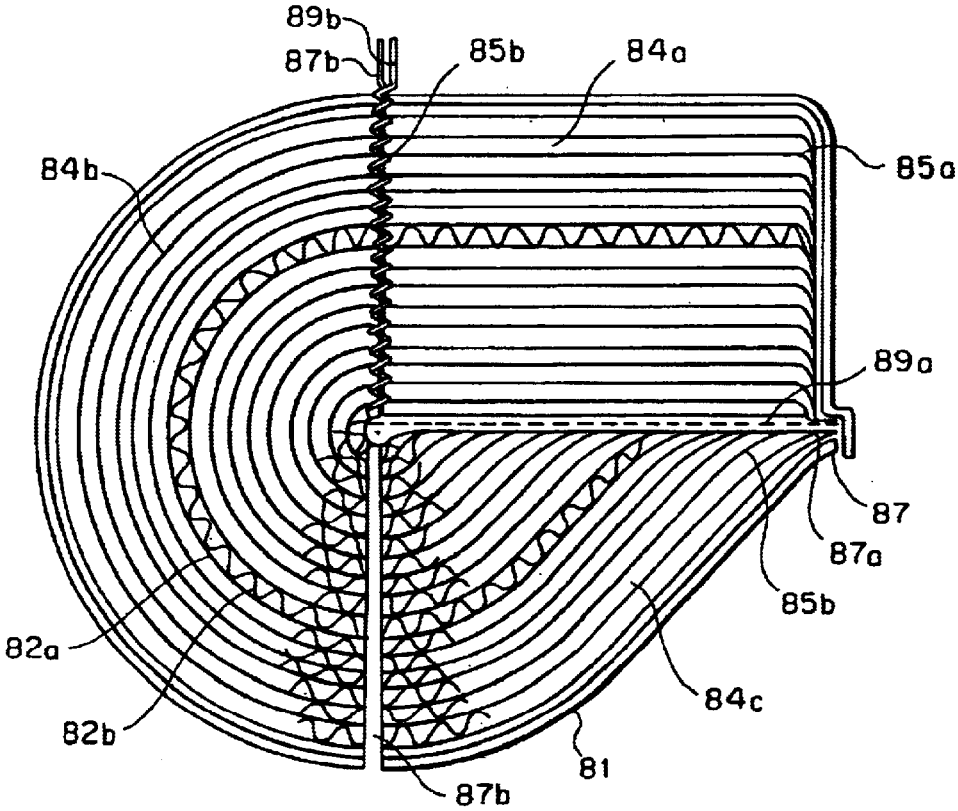
FIG. 8*b* shows a composite honeycomb structure divided into three geometrically different basic shapes, FIGS. 9*a,* 9*b* and 9*c* show the structure and manufacturing method for a round composite honeycomb assembled from two component honeycombs.

FIG. 8*b* shows a composite honeycomb structure divided into three, geometrically different basic shapes 84*a,* 84*b,* 84*c*. In a prefabrication stage, the individual honeycombs are cut from a preformed foil stack of smooth and corrugated foils, bent in meandering fashion, by making transverse parting cuts, e.g. using a wire saw. At the face ends of the cuts, the foil ends are then folded to form assembled partition walls 85*a* and 85*b,* as per FIG. 2*b*. Following assembly of the first partition wall, compressed calibration of the shape of the honeycomb, assembly of second partition wall 85*a* and insertion of an additional connecting element 89*a* as a support between partition walls 85*a,* 85*b* 87*b,* in the form of expanded-metal foil in this case, the final step involves the joint fastening 87*a* of the wall ends with connecting seam 87 of housing 81. The other two partition walls 87*b* for stabilising component honeycomb 84*b* are made up of several individual braces, aligned one behind the other in the direction of flow. They together act as partition walls according to 35*d* or 35*e* in FIG. 2*c*. Necks are cut or shaped with a special tool for subsequent screwing-in of spiral springs 89*b*. They thus form transverse supports and assembled "dowel walls" for better retention of the screwed-in spiral springs. These braces, which are subsequently introduced from the outside through the housing shell, are connected to inner lattice connecting element 89*a* in the middle by screwing-in. At the same time, they are tightly welded and fastened to the outside of the housing.

Figure 9B:
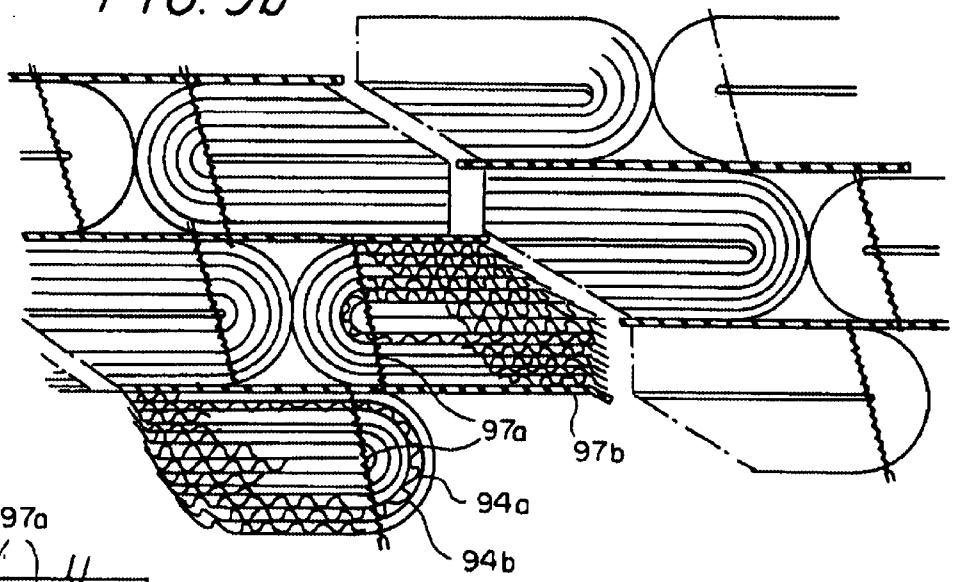
Figure 9A:
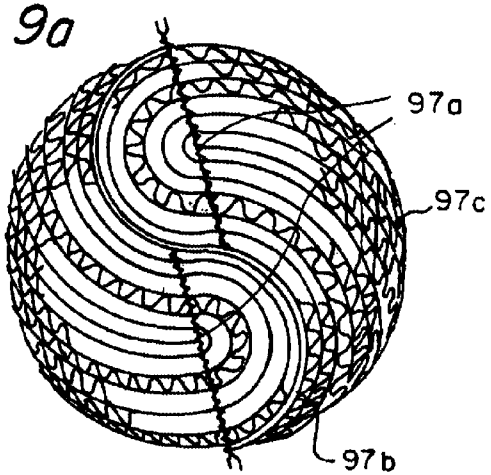

FIGS. 9*a,* 9*b* and 9*c* show the structure and the manufacturing method for a round composite honeycomb, assembled from two component honeycombs, in a common housing. Each of the component honeycombs is divided into secondary cells by means of two or more bracing screws 97*a*. The other walls are formed by overlapping folded foil edges 97*c* on the outer circumferences and by expanded-metal foil 97*b* as a common wall between the adjacent cells.

Alternatively, the honeycomb can also be constructed from two separately prefabricated component honeycombs, such that the expanded metal is replaced by two opposite partition walls. The axially offset arrangement of bracing screws 97*a* relative to each other, with the expanded-metal partition wall or the side walls of the component honeycombs, thermal expansion of the braces in opposite directions can be absorbed by bending of the partition walls.

Figure 9C:
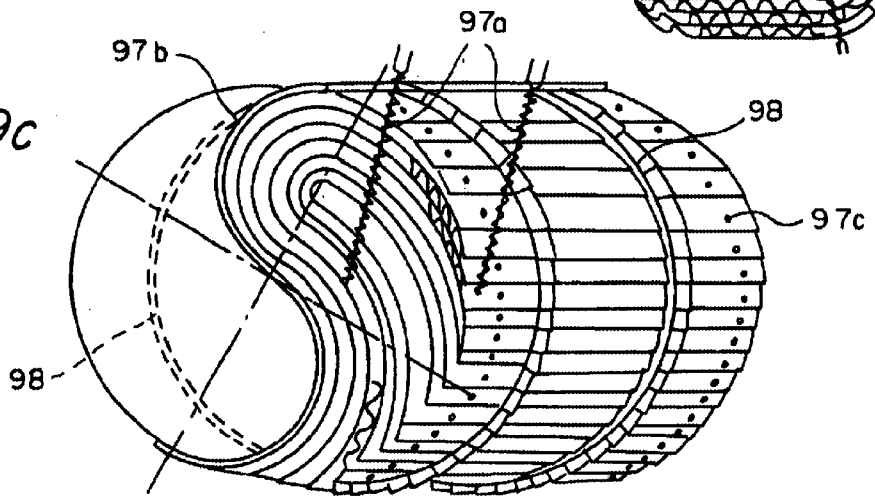

FIG. 9*b* indicates how, by making parting cuts, component honeycomb stacks are formed from endless, multi-layer strips of smooth 94*a* and corrugated 94*b* foils arranged next to each other and bent in meandering fashion. The introduced expanded-metal layer 97*b* and bracing screws 97*a* provisionally fix the two foil packages and the partition wall between in handleable fashion. After shaping the folds and edges at the foil ends into structural wall 97*c,* the entire package is given its round shape. The folded edges are, for example, connected to each other by spot welding, as per FIG. 9*a*. As indicated in FIG. 9*c,* annular ribs for fastening the housing wall are formed from the folded edges by transverse upturns. For additional stabilisation, wires 98 are passed around the honeycomb at these annular ribs and connected to bracing screws 97*a*. For fastening in the housing, the annular ribs are clamped and fixed in circumferential beads of the housing wall, together with wire 98 and the ends of bracing screws 97*a*.

Figure 10:
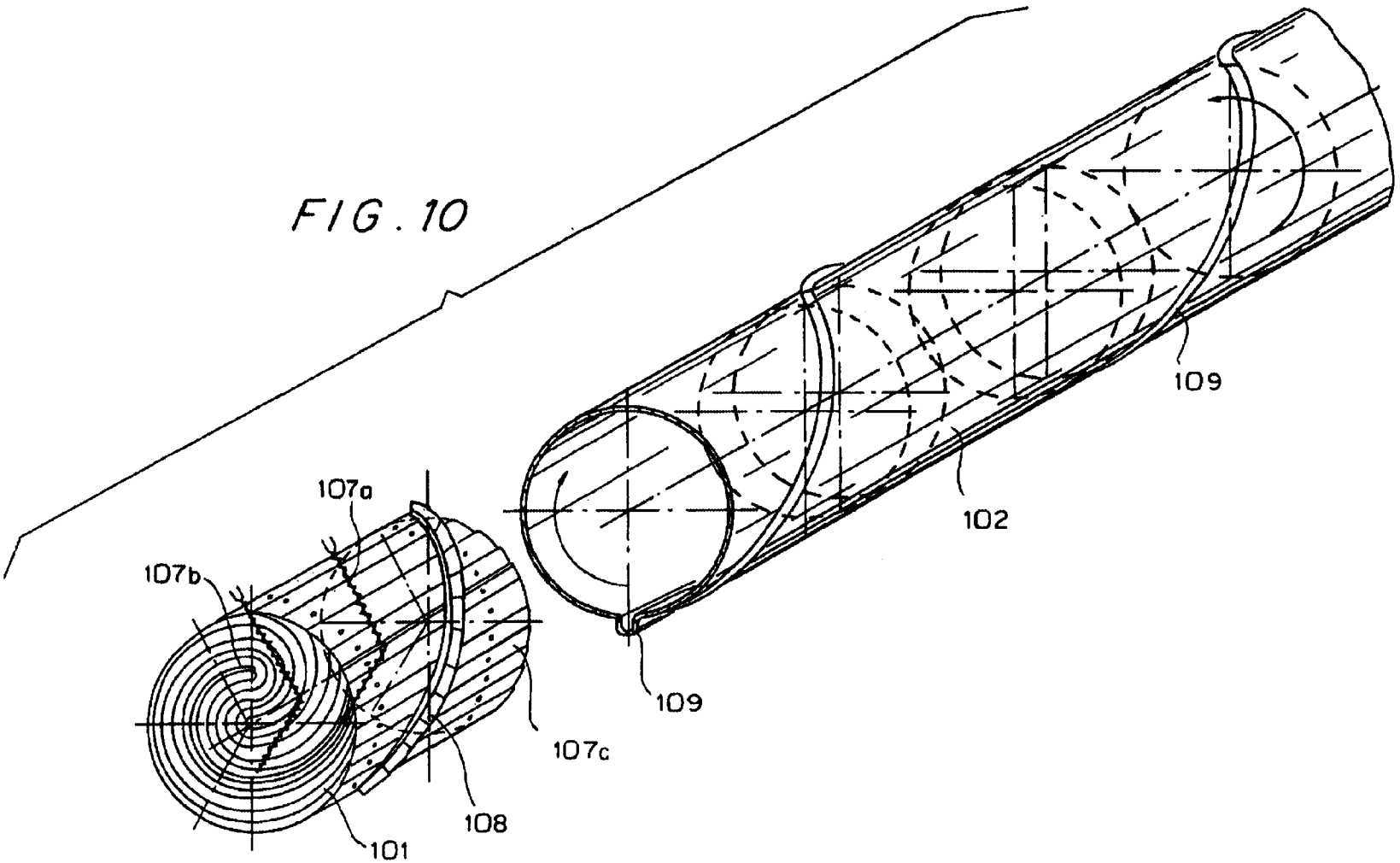
FIG. 10 shows a perspective view of an alternative primary honeycomb structure and a method for fastening in a housing wall.

FIG. 10 shows a perspective view of an alternative primary honeycomb structure 101 and a particularly advantageous method of fastening in housing wall 102. The honeycomb structure is formed as a multi-layer spiral coil from a multi-layer strip bent in meandering fashion, cf. FIG. 9, by means of a parting cut, end-bending and round-shaping. With expanded-metal layer 107*b,* bracing screws 107*a* and overlapping folded foil ends 107*c* as cell walls, four differently shaped cells are simultaneously divided off and fixed, as well as creating housing fastening structures. In order to form a helical rib on half the circumference, cf. FIG. 9*c,* the folded ends are additionally upturned in the transverse direction. Moreover, the folded ends of cell wall structure 107*c* are connected to each other by spot welding for stabilisation. Due to the helical rib, several previously coated honeycombs can simply be screwed one behind the other into a common tubular housing with matching helical bead 109 in a particularly favourable manner. Twisting the tube in the opposite direction, as indicated by the arrows, and simultaneously applying axial pressure at the right ratio eliminates the assembly clearance on the honeycomb circumference and indirectly fastens the honeycombs to the housing wall. The half of the honeycomb opposite the rib, with the semicircular foil layers, is stabilised and connected to the housing by bracing screws 107*a*. To ensure uniform load dissipation into all foil layers, the bracing screws are cross-toothed and screwed through expanded-metal layer 107*b*. Here, differences in expansion relative to the housing wall can be compensated for via a remaining semicircular gap between the area with closed foil and the area of the foil ends, which are capable of moving independently of each other. The bracing screw ends are only welded in and sealed on the housing wall once the helical rib has been fitted and secured. It is also possible to design wall 102 as a sandwich wall made of relatively thin perforated film or expanded metal, together with a stable outer tube. One or more honeycomb slices fastened therein can be cut from long tubular housings of this kind, which can be transported in protected fashion as tube bundles, both flexibly and at low cost for a modular system. This saves on transport packaging and round connecting seams during assembly of exhaust gas systems.

Figure 11:
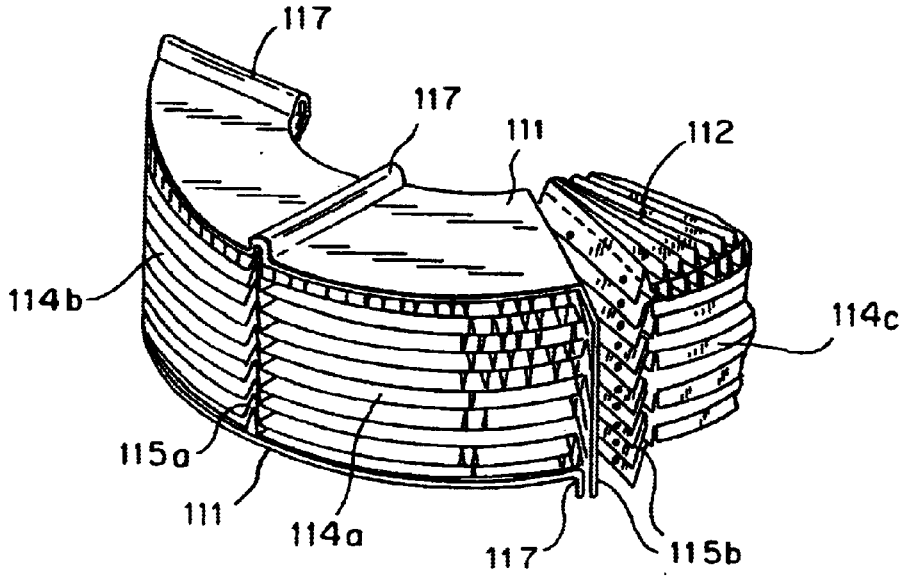
FIG. 11 shows a honeycomb in the form of a hollow cylinder with a housing and honeycombs assembled from circular, structured foils in the form of disks.

FIG. 11 shows a honeycomb in the form of a hollow cylinder with a housing and honeycombs assembled from circular, structured foils 112 in the form of disks, which are joined and held via assembled partition walls 115*a* (cf. FIG. 2*b,* variant C) and 115*b* (cf. FIG. 2*b,* variant A) and fastened to housing 111 at points 117. The fastening of the partition walls in the housing corresponds to variants 37*a* and 37*b* in FIG. 2*c*. Several such honeycomb sections 114*a,* 114*b* with centripetally or centrifugally oriented flow can be combined via the partition walls to form a segment of a hollow cylinder ring and mounted in a cylindrical or truncated cone housing. Smaller hollow cylinder segments, as individual honeycombs or via assembled partition walls 115*a,* 115*b,* can also be combined to form several ring segment elements 117 and housed in a common shell.

The centrally directed flow ducts of the ring-shaped foil layers have a decreasing cross-section, which can be put to advantageous use for specific applications, in accordance with the illustrated foil structure 112.

Figure 12:
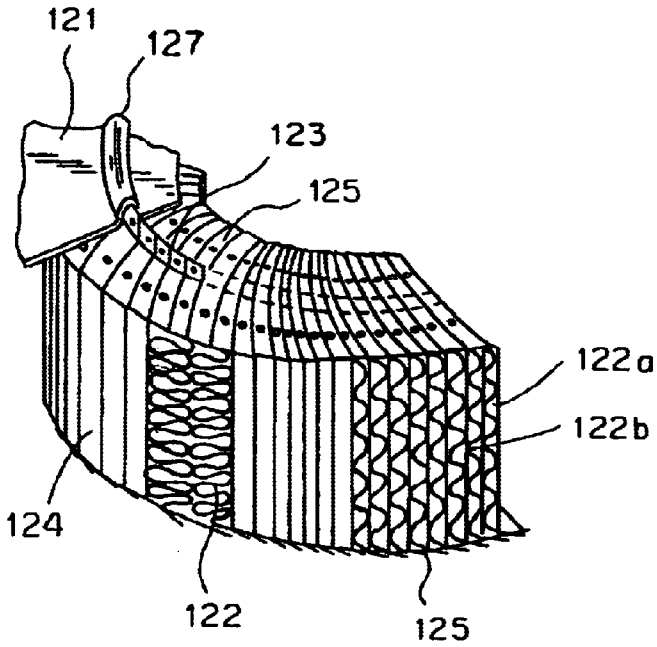
FIG. 12 shows, in reversal of FIG. 11, a foil layer partition wall arrangement made of smooth and corrugated foils bent in identical fashion in the manner of a cylindrical shell.

FIG. 12 shows, in reversal of FIG. 11, the foil layer partition wall arrangement made of smooth 122*a* and corrugated 122*b* foils bent in identical fashion in the manner of a cylindrical shell, which is held and joined at the top and bottom side via assembled ring-shaped partition walls 125. The partition wall structure corresponds to FIG. 2*c* (variant A). Fastening of the partition walls on housing 121 at points 127 at the top and bottom is accomplished via annular ribs 123, which are formed from right-angled outward folds of the partition wall structure, as already explained in connection with FIG. 2*c* (33*g*). These ribs are fastened in likewise annular beads in housing wall 127. Depending on how the foils are identically curved, in almost involute to almost circular fashion, flow ducts are formed in the honeycombs which narrow to a greater or lesser degree. As already described in connection with FIG. 11, this arrangement can be used to manufacture composite honeycomb/housing elements in the form of hollow cylinder segments.

According to the present invention, easily manufactured, specially curved and/or cross-section-enlarging inlet honeycombs of rectangular truncated pyramid-structure have substantial application advantages for exhaust gas systems with several e.g. square-like honeycombs that are flowed through one behind the other. Uniform and low-pressure-loss diffusor expansion of the flow cross-sections in the transitional area from small pipe cross sections of the exhaust gas system to large honeycomb inlet cross-sections and, at the same time, low-turbulence flow deflection, a pressure-loss-reducing diffusor effect and additional honeycomb volume making better use of the available space, can be achieved in this way.

Figure 13A:
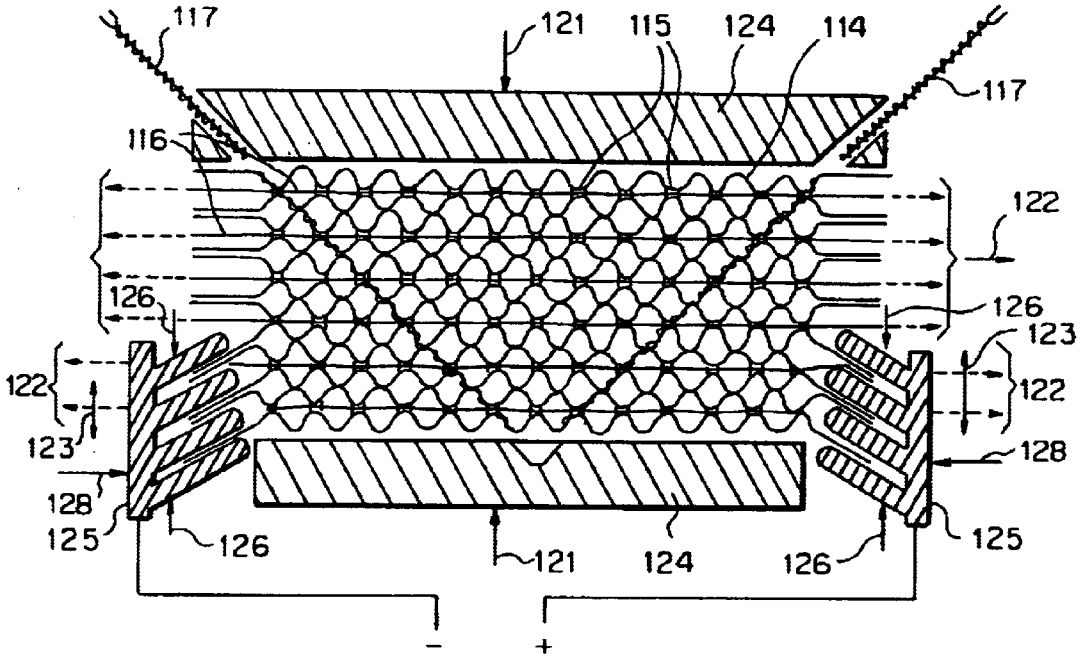
FIG. 13*a* shows the configuration for calibrating, oxidizing, diffusion jointing, and subsequent fixing of the foil layer.
Figure 13B:
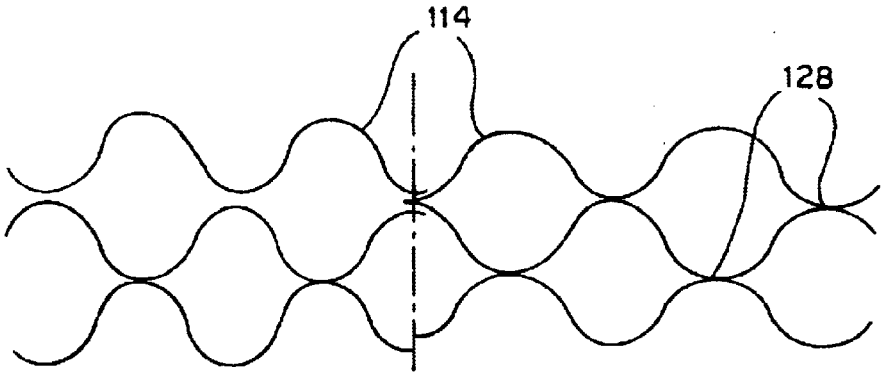
FIG. 13*b* shows calibration of the configuration of FIG. 13*a* by compression.

FIG. 13*a* shows the configuration for the calibration, oxidation, diffusion jointing and subsequent fixing of foil layer 114. Foil strips 114, folded together in zigzag fashion on the lines of webs 115, and wires or strips 116 inserted between them, initially result in a relatively loose system in the intermediate manufacturing stage, as shown on the left in FIG. 13*b*. Calibration by compression, as per FIG. 13*b* (right), is performed from above and below as per arrows 121 while simultaneously pulling on strips or wires 116 in the direction of arrows 122 and supporting structure 125 in the opposite direction as per arrows 128. The honeycomb thus brought into a specified shape is stably fixed for further handling by screwing in braces 117 and by bending down and connecting the lateral foil ends.

Electrical contacting of the foil ends, to which end contacts 125 are squeezed together in direction 126, and resistance heating can be used to reduce internal stresses and, at the same time, to form an adhesive oxide layer for the ceramic coating or, alternatively, to diffusion-join points of foil contact 128. This can optionally be achieved via the temperature, compressive force and ambient atmosphere. It is generally known that a surrounding vacuum and correspondingly high temperatures must be set for diffusion-joining of points of foil contact 128. The foil layers can be heated layer-by-layer in consecutively progressing fashion for only a few foil layers at a time. The contacts are shifted step-by-step along arrows 123 for this purpose. The honeycomb areas not heated in this context thus remain stable for conducting compression forces 121. Soldered connections can also be advantageously produced using a similar procedure. Wires or strips 116 simply coated with solder material can be connected within the honeycombs with optimum soldering gap geometries produced by the application of pressure. Similarly, if coated with solder material, screws 117 can be soldered to the heated foils. Compared to the otherwise customary high-temperature vacuum ovens, this method of honeycomb heating is more economical and less harmful for the environment owing to the energy and time saved, as well as being much more precise due to the more uniform temperature and atmosphere settings.

FIG. 14 shows the manufacture of honeycomb 114 from smooth and corrugated foil layers 114*a,* 114*b*. To produce Z-shaped partition walls, as shown at the top left in FIG. 14, the honeycomb is heated in the area of the radially extending zones 114*c,* indicated by broken lines. The non-heated zones of the honeycomb may be filled with bulk material for additional stabilisation. As shown at the bottom in FIG. 14, the partition walls can be produced by applying pressure directed radially inwards to the outermost foil layer. An appropriate tool for this purpose can display several wings which together form an interior space with an essentially circular cross-section, where the individual wings can be pivoted in the same direction about one of their outer edges running parallel to the longitudinal axis of the honeycomb. Alternatively, or in addition, a rotating shaft 114*d* can also be inserted at the centre of the honeycomb which, for example, acts on the inner wall of the honeycomb via suitable toothing and, upon rotation, draws the plasticised area of the honeycomb inwards. It is also possible to design a corresponding tool whose contour matches contour 114*e* of the deformed honeycomb and which is slowly lowered into the interior of the honeycomb, possibly being rotated in the process.

Figure 15A:
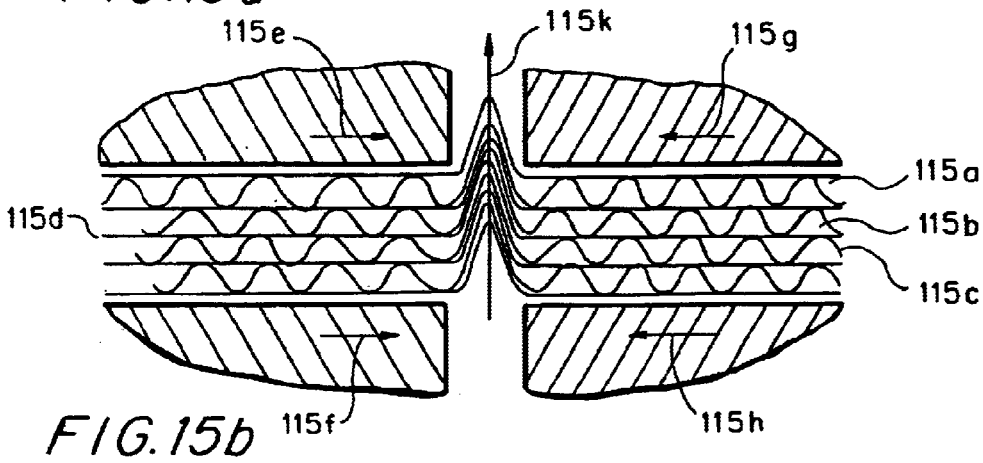
FIG. 15 shows the formation of a partition wall in a honeycomb with horizontally arranged smooth and corrugated foils.
Figure 15B:
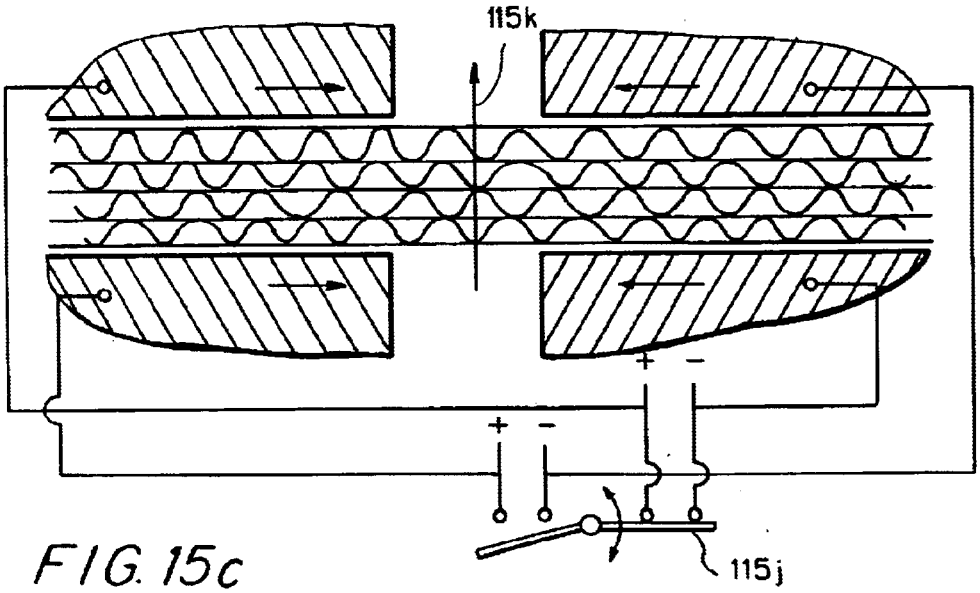
Figure 15C:
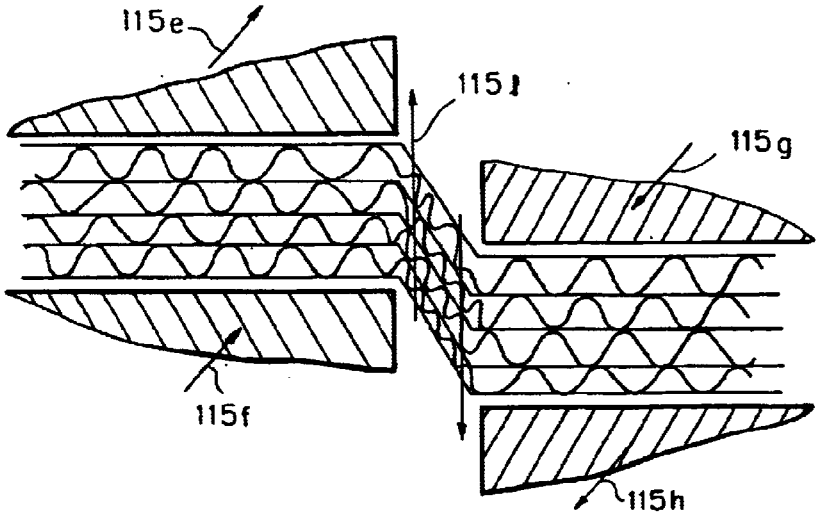

FIG. 15 shows the formation of a partition wall in a honeycomb with horizontally arranged smooth and corrugated foils 115*a,* 115*b*. The end areas of the honeycomb are clamped under slight contact pressure on both sides at opposite end areas 115*c,* 115*d* by means of jaw pairs 115*e, f* and 115*g, h,* where the two jaw pairs are a small distance apart. A voltage is applied to the two jaw pairs by means of voltage source 115*j,* such that a corresponding current heats the foil areas located in the gap between the jaw pairs. The foils can be folded by moving the jaw pairs together. In order to define a preferred folding direction, brace 115*k* is located in the area of the foils to be folded and connected to the foils in a manner capable of bearing tensile stress. Defined foil folds can be produced by applying tension or pressure to brace 115*k* in the direction of the arrow. It is also possible, for example, to provide two or more rows of braces, arranged parallel to each other, so that multiple folds can also be produced.

As shown at the bottom of FIG. 15, the two jaw pairs 115*e, f* and 115*g, h* can also be moved perpendicular to the position of the foils, preferably while simultaneously reducing the width of gap 115*l*, this allowing a Z-shaped foil fold to be produced.

Figure 16A:
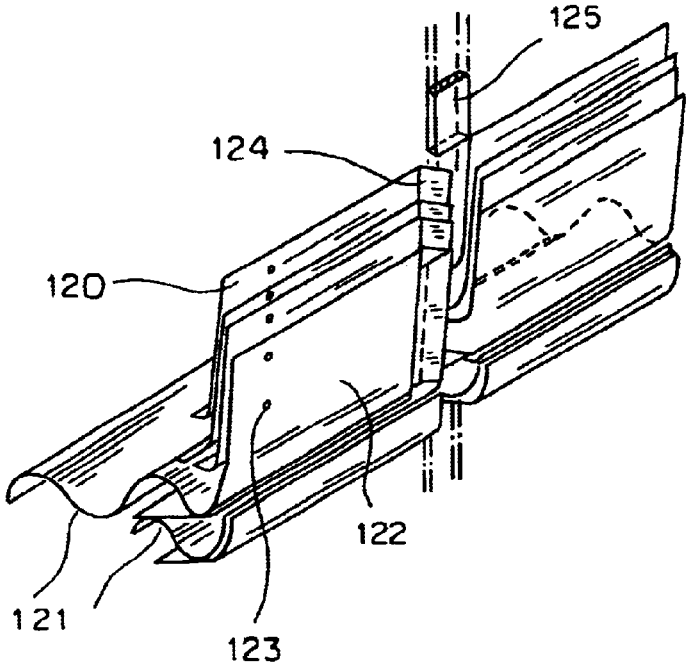
FIG. 16*a* shows a section of a honeycomb with a side wall constructed from overlapping areas of foil layers.

FIG. 16*a* shows a section of a honeycomb with a side wall 122, constructed from overlapping areas 120 of foil layers 121, where the end sections angled in one direction of the foil layer plane are connected to each other by fastening points 123. The fastening points are arranged in offset fashion relative to each other, so that no, especially no direct and straight, continuous thermal bridge is formed from the inside of the honeycomb to the housing. Here, the connecting points are vertically offset relative to each other, i.e. perpendicular to the principal plane of the foil layers, although the line connecting the connecting points can also run at an angle or horizontal to the foil layers.

Foil layer sections 120, which form the side wall, display notched tabs 124 for fastening the foil layers on the housing. As, according to this practical example, all the foil layer ends are provided with overlapping notched tabs, an opening arises in the wall, which is covered in essentially gas-tight fashion by foil strip 125, in order to provide thermal insulation of the inside of the honeycomb from the cooler housing.

Figure 16B:
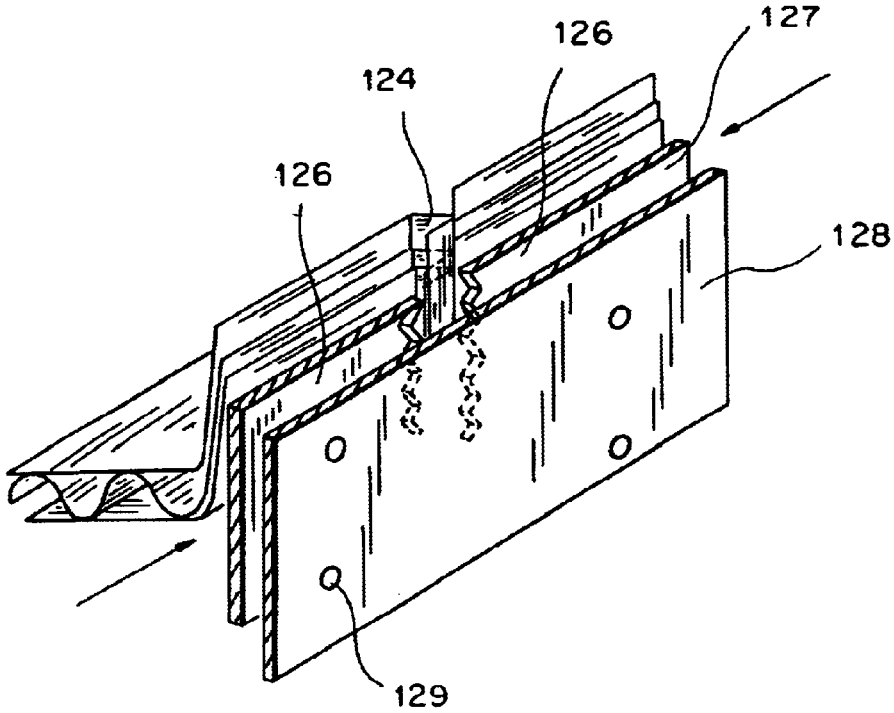
FIG. 16*b* shows a honeycomb in which the face ends of the inner housing which delimit the opening and in which the tabs are fixed, are toothed.

According to FIG. 16*b*, the face ends of areas 126 of inner housing 127, which delimit the opening and in which the tabs are fixed, are toothed, so that tabs 124 are clamped between the teeth when the two parts of the inner housing are slid together in the direction of the arrows.

In the practical example, tabs 124 are of U-shaped design and reach behind the inner housing, so that the free tab ends are additionally clamped between inner housing 127 and outer housing 128 and thus retained in non-positive fashion. After positioning the housing parts, the inner housing can be connected to the outer housing, e.g. by spot welds 129.

What is claimed is:

1. Honeycomb with a honeycomb structure comprising a large number of ducts running in the longitudinal direction of the honeycomb, through which a fluid can flow, constructed of foil layers arranged in stacked form, wherein at least one stiffening element connected with a plurality of foil layers is provided that extends transverse to the foil layers;

the stiffening element being selected from a group consisting of stiffening elements to be disposed within lead-throughs that are closed on all sides so as to stabilize an interior of the honeycomb structure or of stiffening elements being built by sections of the foil layers that are folded down and are connected to each other generating partition walls or outer walls of the honeycomb extending at least partially in a longitudinal direction of the honeycomb, the stiffening element being elastically deformable transverse to a longitudinal direction thereof wherein the stiffening element can be subject to tensile forces in the longitudinal direction thereof and is connected with the foil layers in tensile force absorbing fashion.

2. Honeycomb according to claim 1, wherein a housing is provided and the stiffening element is mounted on the housing in elastically deformable fashion.

3. Honeycomb according to claim 1, wherein sections of the foil layers are provided with singly or multiply folded areas which are connected to a stiffening element (7*c*, 50*a*, 60*a*).

4. Honeycomb according to claim 1, wherein the stiffening elements are directly connected to each other.

5. Honeycomb according to claim 1, wherein several stiffening elements (6, 7*a*, 7*b*, 7*c*, 97*a*, 97*b*) are provided, which are aligned parallel to each other, or whose orientation in one or more directions in space differs by a constant amount in relation to an adjacent stiffening element, and which thus form a group as a whole.

6. Honeycomb according to claim 5, wherein several groups of stiffening elements (6, 7*a*, 7*b*, 7*c*, 97*a*, 97*b*) are provided, where the stiffening elements of different groups display an orientation relative to each other that differs from that of the stiffening elements within a group.

7. Honeycomb according to claim 6, wherein the stiffening elements of different groups are of different design.

8. Honeycomb according to claim 1, wherein in addition to one-dimensional stiffening elements (28,*b*, 40*b*), two-dimensional stiffening elements (27*d*, 47*e*) are also provided, where the one-dimensional stiffening elements (28*b*, 40*b*) are arranged within the two-dimensional stiffening elements (27*d*, 47*e*).

9. Honeycomb according to claim 1, wherein fastening areas for fixing the honeycomb on a housing are provided, which are arranged at a distance from connecting points connecting to foil layer sections to each other.

10. Honeycomb according to claim 1, wherein connecting points connecting consecutive foil layers to each other are at a distance from each other.

11. Honeycomb according to claim 1, having a housing, wherein the housing comprises a double wall forming an inner housing and an outer housing and that the inner housing displays openings in which areas of the honeycomb can be fixed.

12. Honeycomb according to claim 11, wherein the inner housing consists of several parts, which are capable of relative movement and can be fastened to the outer housing independently of each other, and that areas of the honeycomb are fixed between the parts of the inner housing.

13. The honeycomb according to claim 6, wherein stiffening elements of different group are of different construction.

14. The honeycomb according to claim 3, wherein, in addition to one-dimensional stiffening elements (28*b*, 40*b*), two-dimensional stiffening elements (27*d* 47*e*) are also provided, where the one-dimensional stiffening elements (28*b*, 40*b*) are arranged within the two-dimensional stiffening elements (27*d*, 47*e*).

15. The honeycomb according to claim 9, wherein said connecting points connecting consecutive foil layers to each other are spaced from each other.

16. Honeycomb with a honeycomb structure comprising a large number of ducts running in the longitudinal direction of the honeycomb, through which a fluid can flow, constructed of foil layers arranged in stacked form, wherein at least one stiffening element connected with a plurality of foil layers is provided that extends transverse to the foil layers;

the stiffening element being selected from a group consisting of stiffening elements to be disposed within lead-throughs that are closed on all sides so as to stabilize an interior of the honeycomb structure or of stiffening elements being built by sections of the foil layers that are folded down and are connected to each other generating partition walls or outer walls of the honeycomb extending at least partially in a longitudinal direction of the honeycomb, the stiffening element being elastically deformable transverse to a longitudinal direction thereof wherein the stiffening element can be subject to tensile forces in the longitudinal direction thereof and is connected with the foil layers in tensile force absorbing fashion, and wherein a housing is provided and the stiffening element is mounted on the housing in elastically deformable fashion.

17. A honeycomb with a honeycomb structure comprising a large number of ducts running in the longitudinal direction of the honeycomb, through which a fluid can flow, constructed of foil layers arranged in stacked form, wherein a. at least one stiffening element connected with a plurality of foil layers is provided that extends transverse to the foil layers;

b. the stiffening element being selected from a group consisting of stiffening elements passing through the foil layers with an entire cross section of each being spaced at a distance from edges of the foil layers so as to stabilize an interior of the honeycomb structure or of stiffening elements being built by sections of the foil layers that are folded down and are connected to each other generating partition walls or outer walls of the honeycomb extending at least partially in a longitudinal direction of the honeycomb;

c. the stiffening elements being elastically deformable transverse to a longitudinal direction thereof, wherein the stiffening element can be subject to tensile forces in the longitudinal direction thereof and is connected with the foil layers in tensile force absorbing fashion;

d. wherein in addition to one-dimensional stiffening elements, two-dimensional stiffening elements are also provided, and that the one-dimensional stiffening elements pass through the two-dimensional stiffening elements, including an angle relative to the principal plane.

18. A honeycomb with a honeycomb structure comprising a large number of ducts running in the longitudinal direction of the honeycomb, through which a fluid can flow, constructed of foil layers arranged in stacked form, wherein a. at least one stiffening element connected with a plurality of foil layers is provided that extends transverse to the foil layers;

b. the stiffening element being selected from a group consisting of stiffening elements passing through the foil layers with an entire cross section of each being spaced at a distance from the foil layers so as to stabilize an interior of the honeycomb structure or of stiffening elements being built by sections of the foil layers that are folded down and are connected to each other generating partition walls or outer walls of the honeycomb extending at least partially in a longitudinal direction of the honeycomb;

c. the stiffening elements being elastically deformable transverse to a longitudinal direction thereof, wherein the stiffening element can be subject to tensile forces in the longitudinal direction thereof and is connected with the foil layers in tensile force absorbing fashion;

wherein foils with angled areas are provided, which are connected to each other to form a wall area of the honeycomb extending transverse to the foil layers.

19. A honeycomb with a honeycomb structure comprising a large number of ducts running in the longitudinal direction of the honeycomb, through which a fluid can flow, constructed of foil layers arranged in stacked form, wherein a. at least one stiffening element connected with a plurality of foil layers is provided that extends transverse to the foil layers;

b. the stiffening element being selected from a group consisting of stiffening elements passing through the foil layers with an entire cross section of each being spaced at a distance from the foil layers so as to stabilize an interior of the honeycomb structure or of stiffening elements being built by sections of the foil layers that are folded down and are connected to each other generating partition walls or outer walls of the honeycomb extending at least partially in a longitudinal direction of the honeycomb;

c. the stiffening elements being elastically deformable transverse to a longitudinal direction thereof, wherein the stiffening element can be subject to tensile forces in the longitudinal direction thereof and is connected with the foil layers in tensile force absorbing fashion;

d. wherein stiffening elements are directly connected to each other;

e. wherein, in addition to one-dimensional stiffening elements, two-dimensional stiffening elements are also provided, and that the one-dimensional stiffening elements pass through the two-dimensional stiffening elements, including an angle relative to the principal plane.

* * * * *